US010565929B2

(12) United States Patent
Kim et al.

(10) Patent No.: US 10,565,929 B2
(45) Date of Patent: Feb. 18, 2020

(54) ORGANIC LIGHT EMITTING DISPLAY

(71) Applicant: LG Display Co., Ltd., Seoul (KR)

(72) Inventors: Daekyu Kim, Gumi-si (KR); Jungchul Kim, Paju-si (KR); Heekwang Kang, Goyang-si (KR); Junyoung Kwon, Busan (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/016,438

(22) Filed: Jun. 22, 2018

(65) Prior Publication Data

US 2018/0301088 A1 Oct. 18, 2018

Related U.S. Application Data

(63) Continuation of application No. 15/164,704, filed on May 25, 2016, now Pat. No. 10,032,413.

(30) Foreign Application Priority Data

May 28, 2015 (KR) ..... 10-2015-0075339
Nov. 30, 2015 (KR) ..... 10-2015-0169474
Apr. 30, 2016 (KR) ..... 10-2016-0053639

(51) Int. Cl.
*G09G 3/32* (2016.01)
*G09G 3/3241* (2016.01)
(Continued)

(52) U.S. Cl.
CPC ..... *G09G 3/3241* (2013.01); *G09G 3/3233* (2013.01); *G09G 3/3266* (2013.01);
(Continued)

(58) Field of Classification Search
CPC .. G09G 3/3241; G09G 3/3233; G09G 3/3266; G09G 3/3291; G09G 2300/0426;
(Continued)

(56) References Cited

U.S. PATENT DOCUMENTS 6,859,193 B1 2/2005 Yumoto
8,994,711 B2 * 3/2015 Yamauchi ..... H01L 27/1251 345/211
(Continued)

FOREIGN PATENT DOCUMENTS

EP 1840866 A2 10/2007
EP 2146337 A1 1/2010
(Continued)

OTHER PUBLICATIONS

European Extended Search Report, European Application No. 16171255.9, dated Nov. 23, 2016, 31 pages.
(Continued)

*Primary Examiner* — Stephen G Sherman
(74) *Attorney, Agent, or Firm* — Fenwick & West LLP

(57) ABSTRACT

An organic light emitting display comprises a display panel having a plurality of pixels, a gate drive circuit that drives scan lines and emission lines on the display panel, and a data drive circuit that drives data lines on the display panel, (n−1)th and nth pixels arranged in a row, a transistor array having a driving transistor, a sampling transistor, and a first initial transistor, and a capacitor connected between an initial voltage input terminal and the sampling transistor. A gate electrode of the first initial transistor for initializing the driving transistor of the nth pixel is connected to a scan line in the (n−1)th pixel.

9 Claims, 25 Drawing Sheets

(51) Int. Cl.
*G09G 3/3233* (2016.01)
*G09G 3/3266* (2016.01)
*G09G 3/3291* (2016.01)

(52) U.S. Cl.
CPC ..... *G09G 3/3291* (2013.01); *G09G 2300/043* (2013.01); *G09G 2300/0426* (2013.01); *G09G 2300/0814* (2013.01); *G09G 2300/0819* (2013.01); *G09G 2300/0861* (2013.01); *G09G 2310/0251* (2013.01); *G09G 2310/0256* (2013.01); *G09G 2310/0262* (2013.01); *G09G 2310/0278* (2013.01); *G09G 2320/0238* (2013.01); *G09G 2320/043* (2013.01)

(58) Field of Classification Search
CPC ..... G09G 2300/043; G09G 2300/0814; G09G 2300/0819; G09G 2300/0861; G09G 2310/0251; G09G 2310/0262; G09G 2310/0278; G09G 2320/043
USPC ..... 345/76–83, 691; 315/169.3
See application file for complete search history.

(56) References Cited

U.S. PATENT DOCUMENTS

| | | | | |
|---|---|---|---|---|
| 9,747,838 | B2 * | 8/2017 | Kang | G09G 3/003 |
| 2003/0103022 | A1 | 6/2003 | Noguchi et al. | |
| 2004/0108819 | A1 * | 6/2004 | Arai | G02F 1/163 315/169.3 |
| 2005/0017934 | A1 | 1/2005 | Chung et al. | |
| 2006/0244695 | A1 * | 11/2006 | Komiya | G09G 3/006 345/76 |
| 2007/0090345 | A1 | 4/2007 | Wu et al. | |
| 2008/0143653 | A1 | 6/2008 | Shishido | |
| 2009/0167648 | A1 | 7/2009 | Jeon et al. | |
| 2010/0045586 | A1 | 2/2010 | Kim | |
| 2010/0073358 | A1 * | 3/2010 | Ozaki | G09G 3/3233 345/214 |
| 2010/0123700 | A1 * | 5/2010 | Kim | G09G 3/3233 345/211 |
| 2011/0115764 | A1 | 5/2011 | Chung | |
| 2012/0001893 | A1 | 1/2012 | Jeong et al. | |
| 2014/0077176 | A1 | 3/2014 | Lee et al. | |
| 2015/0325705 | A1 | 11/2015 | Choi et al. | |

FOREIGN PATENT DOCUMENTS

| | | | |
|---|---|---|---|
| EP | 2450869 | A1 | 5/2012 |
| EP | 2750123 | A1 | 7/2014 |
| KR | 10-2007-0027265 | A | 3/2007 |
| KR | 10-2008-0056098 | A | 6/2008 |
| KR | 10-2010-0009219 | A | 1/2010 |
| KR | 10-2010-0022372 | A | 3/2010 |
| KR | 10-2011-0092820 | A | 8/2011 |
| KR | 10-2011-0121889 | A | 11/2011 |
| KR | 10-1404951 | B1 | 5/2012 |
| KR | 10-2012-0070773 | A | 7/2012 |

OTHER PUBLICATIONS

European Partial Search Report, European Application No. 16171255.9, dated Aug. 5, 2016, 10 pages.
Korean Office Action, Korean Application No. 10-2016-0117579, dated Apr. 10, 2018, 8 pages (with concise explanation of relevance).
United States Office Action, U.S. Appl. No. 15/164,704, dated Feb. 27, 2018, 11 pages.
United States Office Action, U.S. Appl. No. 15/164,704, dated Oct. 10, 2017, 25 pages.
Interview Summary dated Dec. 3, 2019 consultation, European Patent Application No. 16171255.9, dated Dec. 4, 2019, 4 pages.

* cited by examiner

FIG. 6

| Period / Node | Pi | Ps | Pe |
|---|---|---|---|
| A | Vini | Vdata-Vth | Vdata-Vth |
| B | $V_{OLED}$ | Vdata | $V_{OLED}$ |
| C | $V_{OLED}$ | $V_{OLED}$ | $V_{OLED}$ |

FIG. 10

| Node \ Period | Pi | Ps | Pe |
|---|---|---|---|
| A | Vini | Vdata-Vth | Vdata-Vth |
| B | $V_{OLED}$ | Vdata | $V_{OLED}$ |
| C | $V_{OLED}$ | Vinit | $V_{OLED}$ |

ORGANIC LIGHT EMITTING DISPLAY

This application is a continuation of U.S. patent application Ser. No. 15/164,704 filed on May 25, 2016, which claims the priority benefit of Korean Patent Application No. 10-2015-0075339 filed on May 28, 2015, Korean Patent Application No. 10-2015-0169474 filed on Nov. 30, 2015, and Korean Patent Application No. 10-2016-0053639 filed on Apr. 30, 2016, all of which are incorporated herein by reference for all purposes as if fully set forth herein.

BACKGROUND

Field

The present disclosure relates to an active-matrix organic light emitting display.

Discussion of the Related Art

An active-matrix organic light emitting display comprises self-luminous organic light emitting diodes OLED, and has the advantages of fast response time, high luminous efficiency, high luminance, and wide viewing angle.

An organic light emitting diode OLED, which is a self-luminous device, has the structure shown in FIG. 1. The organic light emitting diode OLED comprises an anode and a cathode, and organic compound layers formed between the anode and the cathode. The organic compound layers comprise a hole transport layer HTL, an emission layer EML, and an electron transport layer ETL. When an operating voltage is applied to the anode and the cathode, a hole (indicated by "+" in FIG. 1) passing through the hole transport layer HTL and an electron (indicated by "−" in FIG. 1) passing through the electron transport layer ETL move to the emission layer EML, and forming an exciton. As a result, the emission layer EML generates visible light.

Despite their high contrast ratio and color reproduction, organic light emitting displays may have a leakage current due to unexpected light emission from organic light emitting diodes during operation of a compensation circuit, resulting in a reduction in the efficiency of the organic light emitting diodes.

SUMMARY

In an exemplary embodiment of this disclosure, an organic light emitting display comprises a display panel having a plurality of pixels, a gate drive circuit that drives scan lines and emission lines on the display panel, and a data drive circuit that drives data lines on the display panel. Each of the pixels is arranged in an nth row (n is a natural number) and includes an organic light emitting diode having an anode connected to a node C and a cathode connected to a low-level driving voltage input terminal, a driving transistor having a gate electrode connected to a node A, a source electrode connected to a node D, and a drain electrode connected to a node B, the driving transistor controlling a driving current applied to the organic light emitting diode, a first transistor that is connected between a data line and the node D, a second transistor that is connected between the node D and a high-level driving voltage input terminal, a third transistor that is connected to the node A and the node B, a fourth transistor that is connected to the node B and the node C, a fifth transistor that is connected between the node A and an initial voltage input terminal, and a capacitor that is connected between the node A and the initial voltage input terminal.

In another exemplary embodiment of this disclosure an organic light emitting display comprises a display panel having a plurality of pixels, a gate drive circuit that drives scan lines and emission lines on the display panel, and a data drive circuit that drives data lines on the display panel. Each of the pixels is arranged in an nth row (n is a natural number) and includes an organic light emitting diode having an anode connected to a node C and a cathode connected to a low-level driving voltage input terminal, a driving transistor having a gate electrode connected to a node A, a source electrode connected to a high-level driving voltage input terminal, and a drain electrode connected to a node B, the driving transistor controlling a driving current applied to the organic light emitting diode, a first transistor that is connected between a data line and a node D, a second transistor that is connected to the node A and the node B, a third transistor that is connected between the node D and an initial voltage input terminal, a fourth transistor that is connected to the node B and the node C, a fifth transistor that is connected between the node A and the initial voltage input terminal, a sixth transistor that is connected between the initial voltage input terminal and the node C, and a capacitor that is connected to the node A and the node D.

In another exemplary embodiment of this disclosure an organic light emitting display comprises (n−1)th and nth pixels arranged in a row, a transistor array having a driving transistor, a sampling transistor, and a first initial transistor, and a capacitor connected between an initial voltage input terminal and the sampling transistor. The gate electrode of the first initial transistor for initializing the driving transistor of the nth pixel is connected to a scan line in the (n−1)th pixel.

In further exemplary embodiment of this disclosure an organic light emitting display comprises (n−1)th and nth pixels arranged in a row, organic light emitting diodes arranged at each pixel, an initial transistor in the nth pixel and connected to an (n−1)th scan line of the (n−1)th pixel, a sampling transistor in the nth pixel and connected to an nth scan line, and an emission transistor in the nth pixel and connected to an nth emission line. One frame for driving the organic light emitting diodes comprises an initial period, a sampling period, and an emission period, and in the initial period, an (n−1)th scan signal is applied at an ON level, and an nth scan signal and an nth emission signal are applied at an OFF level, in the sampling period, the nth scan signal is applied at the ON level, and the (n−1)th scan signal and the nth emission signal are applied at the OFF level, and in the emission period, the nth emission signal is applied at the ON level, and the (n−1)th scan signal and the nth scan signal are applied at the OFF level.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings:

FIG. 6 is a view showing the voltages for nodes A, B, and C of the pixel during the initial period, sampling period, and emission period;

FIG. 10 is a view showing the voltages for nodes A, B, and C of the pixel during the initial period, sampling period, and emission period;

DETAILED DESCRIPTION

Figure 1:
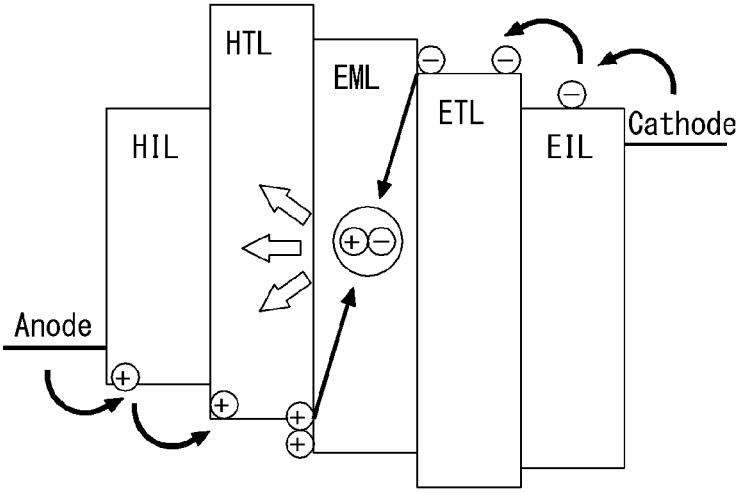
FIG. 1 (Prior Art)
FIG. 1 is a view showing an organic light emitting diode and the principle of light emission by the organic light emitting diode.

The various aspects and features of the present disclosure and methods of accomplishing the same may be understood more readily by reference to the following detailed descriptions of exemplary embodiments and the accompanying drawings. The present disclosure may, however, be embodied in many different forms and should not be construed as being limited to the exemplary embodiments set forth herein. Rather, these exemplary embodiments are provided so that this disclosure will be thorough and complete and will fully convey the concept of the present disclosure to those skilled in the art, and the present disclosure is defined by the appended claims.

The shapes, sizes, proportions, angles, numbers, etc. shown in the figures to describe the exemplary embodiments of the present disclosure are merely examples and not limited to those shown in the figures. Like reference numerals denote like elements throughout the specification. In describing the present disclosure, detailed descriptions of related well-known technologies will be omitted to avoid unnecessary obscuring of the present disclosure. When the terms 'comprise', 'have', 'include' and the like are used, other parts may be added as long as the term 'only' is not used. The singular forms may be interpreted as the plural forms unless explicitly stated.

The elements may be interpreted to include an error margin even if not explicitly stated.

When the position relation between two parts is described using the terms 'on', 'over', 'under', 'next to' and the like, one or more parts may be positioned between the two parts as long as the term 'immediately' or 'directly' is not used.

When the temporal relationship between two events is described using the terms 'after', 'following', 'next', 'before' and the like, the two events may not occur in succession as long as the term 'immediately' or 'directly' is not used.

It will be understood that, although the terms first, second, etc., may be used to describe various elements, these elements should not be limited by these terms. These terms are only used to distinguish one element from another element. Thus, a first element discussed below could be termed a second element without departing from the technical spirit of the present disclosure.

The features of various exemplary embodiments of the present disclosure may be combined with one another either partly or wholly, and may technically interact or work together in various ways. The exemplary embodiments may be carried out independently or in combination with one another.

Hereinafter, exemplary embodiments of the present disclosure will be described in detail with reference to the accompanying drawings. The same reference numerals refer to substantially the same elements throughout the specification. In the following description, when it is deemed that detailed description of well-known functions or configurations related to the present invention may unnecessarily obscure the subject matter of the present invention, the detailed description thereof will be omitted.

Although the exemplary embodiments disclose that all transistors constituting each pixel are P-type transistors, the technical idea of this disclosure is not limited thereto and the transistors may be N-type, or a combination of P-type transistors and N-type transistors.

A pixel structure for the aforementioned organic light emitting display may comprise a driving transistor, a capacitor, and a plurality of transistors. Initial, sampling, and emission steps are required to drive the organic light emitting diode.

Initializing may be done by applying an initial voltage to a gate terminal of the driving transistor and an anode terminal of the organic light emitting diode. The gate terminal of the driving transistor is initialized to an initial voltage Vini. Hereupon, an unwanted electric current may flow to the organic light emitting diode, thereby reducing the efficiency of the organic light emitting diode. Also, an excessive electric current may flow instantaneously to an input terminal of the initial voltage (Vini), causing a display quality defect and damage to circuit components due to an instantaneous drop in the initial voltage Vini.

Constant electric current flowing from the driving transistor to the organic light emitting diode can ensure reliability. However, the characteristics of a semiconductor layer of the driving transistor change over time. That is, the threshold voltage of the driving transistor can be changed to a negative or positive voltage. Accordingly, a plurality of transistors and a capacitor need to be arranged within the pixel in order to compensate for a change in the threshold voltage of the driving thin film transistor and allow the organic light emitting diode to emit light with a target luminance. To compensate for changes in the characteristics of the semiconductor layer of the driving transistor, more transistors are arranged in a limited pixel area and their arrangement becomes complex, thus it becomes difficult to simplify a pixel structure and a layout of the pixel for a given pixel area.

Moreover, more pixels are required for light emission, in order to make high-resolution displays. For this reason, the length of 1 horizontal period (H) is shortened and thus the sampling period also is shortened. The shortened sampling period may lower the accuracy of threshold voltage compensation of the driving transistor.

Therefore, one aspect of this disclosure is to provide an organic light emitting display that blocks an electric current flowing to the organic light emitting diode at times other than an emission period and ensures the accuracy of threshold voltage compensation of the driving transistor.

Another aspect of this disclosure is to provide an organic light emitting display which ensures design margin within a pixel area by reducing the number of contact holes for connecting a plurality of transistors and a capacitor.

Another aspect of this disclosure is to provide an organic light emitting display which can improve the accuracy of threshold voltage compensation of the driving transistor by ensuring a sufficient sampling period.

Another aspect of this disclosure is to provide an organic light emitting display which prevents the effect of a mobile charge on a semiconductor layer of the driving transistor.

The aspects of the present disclosure are not limited to the above-mentioned aspects, and other aspects will be apparent to those skilled in the art in the following description.

Hereinafter, exemplary embodiments of the present disclosure will be described in detail with reference to FIGS. 2 to 21.

Figure 2:
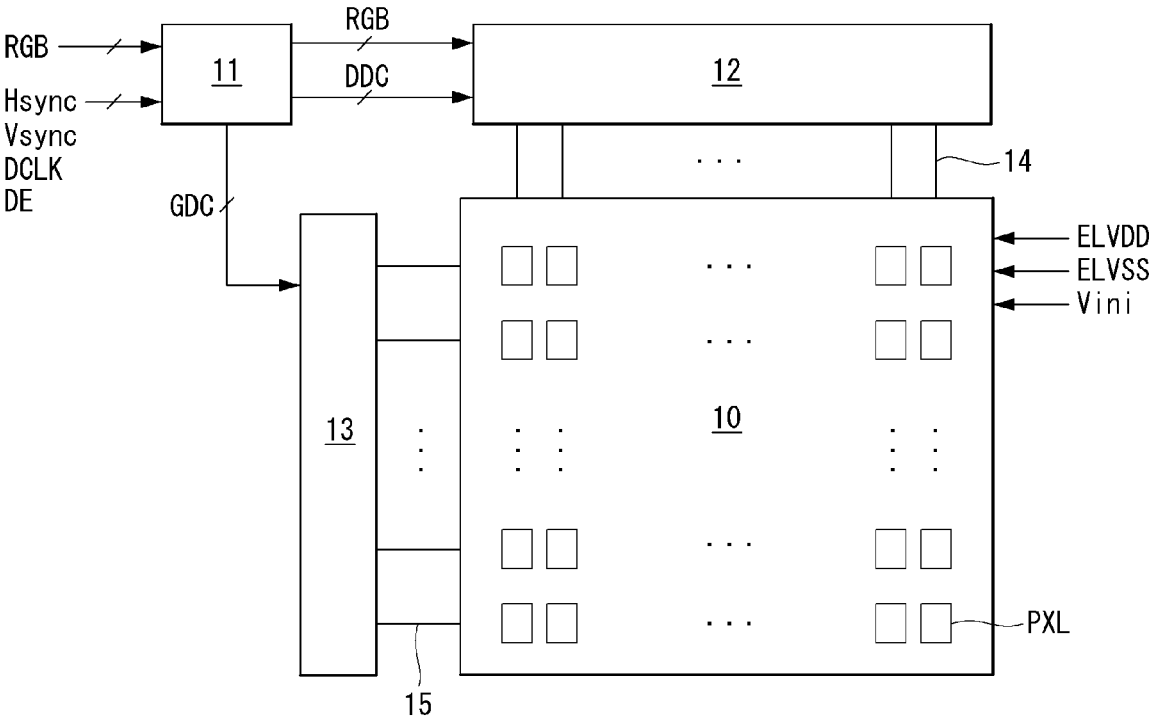
FIG. 2 is a view showing an organic light emitting display according to an exemplary embodiment of the present disclosure.

FIG. 2 is a view showing an organic light emitting display according to an exemplary embodiment of the present disclosure.

Referring to FIG. 2, an organic light emitting display according to an exemplary embodiment of the present disclosure comprises a display panel 10 with pixels PXL, a data drive circuit 12 for driving data lines 14, a gate drive circuit 13 for driving gate lines 15, and a timing controller 11 for controlling the operation timings of the data drive circuit 12 and gate drive circuit 13.

A plurality of data lines 14 and a plurality of gate lines 15 intersect each other on the display panel 10, and the pixels PXL are arranged in a matrix at the intersections. Pixels PXL arranged on the same horizontal line constitute one pixel row. Pixels PXL arranged on one pixel row are connected to one gate line 15, and this gate line 15 may comprise at least one scan line and at least one emission line. That is, each pixel PXL may be connected to one data line 14, at least one scan line, and at least one emission line. The pixels PXL may commonly receive high-level driving voltage ELVDD and low-level driving voltage ELVSS and an initial voltage Vini from a power generator. The initial voltage Vini may be chosen from a range of voltages lower than operating voltage of organic light emitting diodes OLED to prevent unnecessary light emission by the organic light emitting diodes OLED during an initial period and a sampling period. That is, the initial voltage Vini may be set equal to or lower than the low-level driving voltage ELVSS. Accordingly, by applying the initial voltage Vini, which is lower than the low-level driving voltage ELVSS, during the initial period, unnecessary light emission from the organic light emitting diodes OLED can be suppressed, resulting in an improvement in the lifetime of the organic light emitting diodes OLED.

The transistors comprising each pixel PXL may be implemented as oxide transistors having an oxide semiconductor layer. The oxide transistors are advantageous for the display panel 10 to have a large area, when electron mobility, process deviation, etc. are all taken into consideration. The oxide semiconductor layer may be formed of, but is not limited to, ITO (indium tin oxide), IZO (indium zinc oxide), IGZO (indium gallium zinc oxide), or ITZO (indium tin zinc oxide). The present disclosure is not limited to the oxide transistors, and the semiconductor layer of the transistors may be formed of amorphous silicon (a-Si), polycrystalline silicon (poly-Si), organic semiconductor, etc. Each individual pixel PXL comprises a plurality of transistors and capacitors to compensate for changes in the threshold voltage of a driving transistor. A pixel structure disclosed herein can compensate for changes in the threshold voltage of the driving transistor and ensure a sampling period for compensating the threshold voltage. This will be described later in detail with reference to FIGS. 3 to 21.

Figure 3:
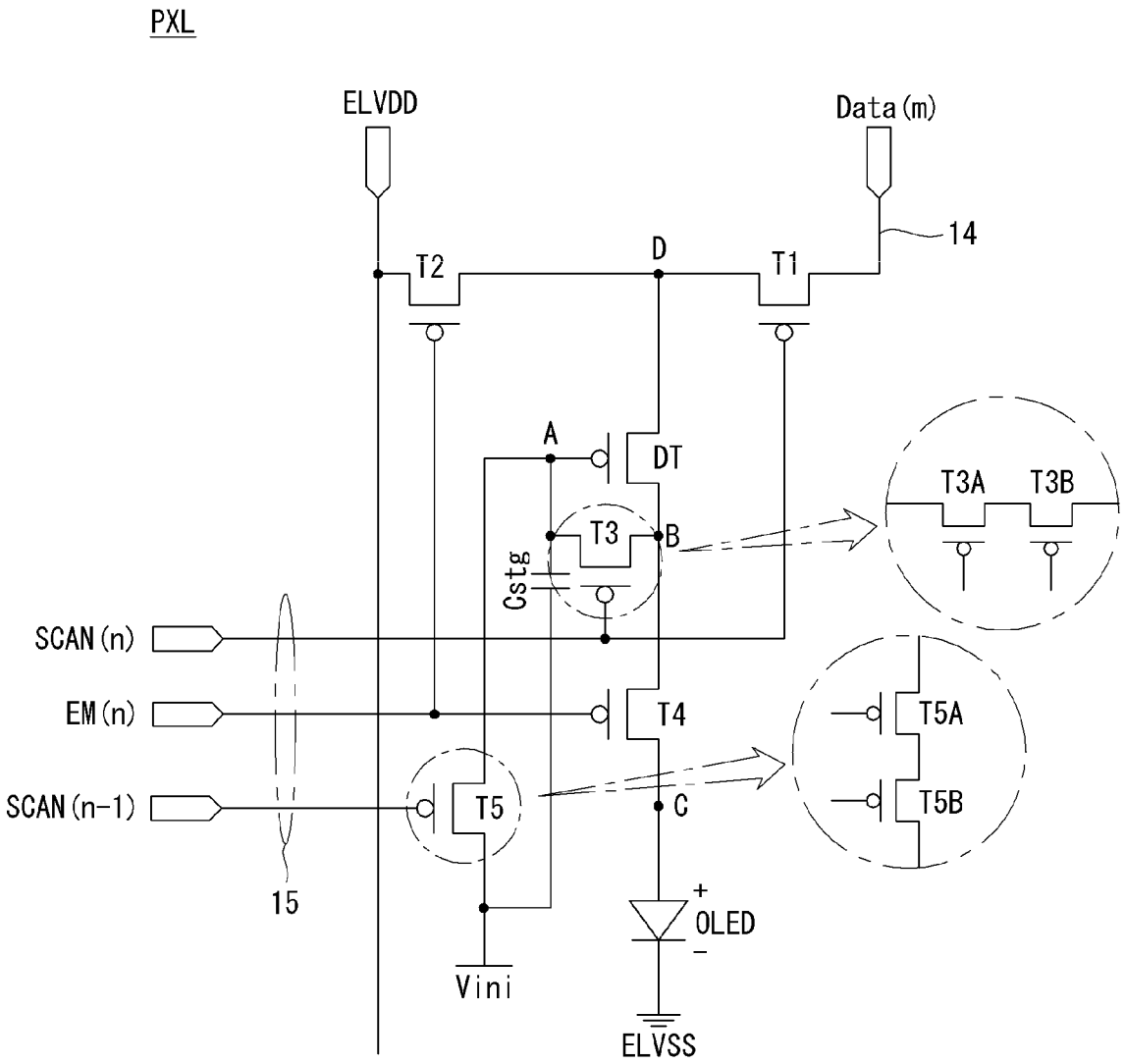
FIG. 3 is an equivalent circuit diagram of a pixel structure according to an exemplary embodiment of the present disclosure.

In each pixel PXL, each transistor whose source or drain electrode is connected to one electrode of the capacitor may comprise at least two series-connected transistors so as to suppress the effect of leakage current as much as possible. The at least two series-connected transistors are switched on by a same control signal. For example, the third transistor T3 may be designed as a double-gate transistor comprising T3A and T3B, as shown in FIG. 3, which are switched on by the same control signal and connected in series. Likewise, the fifth transistor T5 may be designed as a double-gate transistor comprising T5A and T5B which are switched on by the same control signal and connected in series. As used below, the term "a double-gate transistor" refers to a structure in which two transistors are connected in series with gate electrodes of the two transistors connected together.

Figure 7:
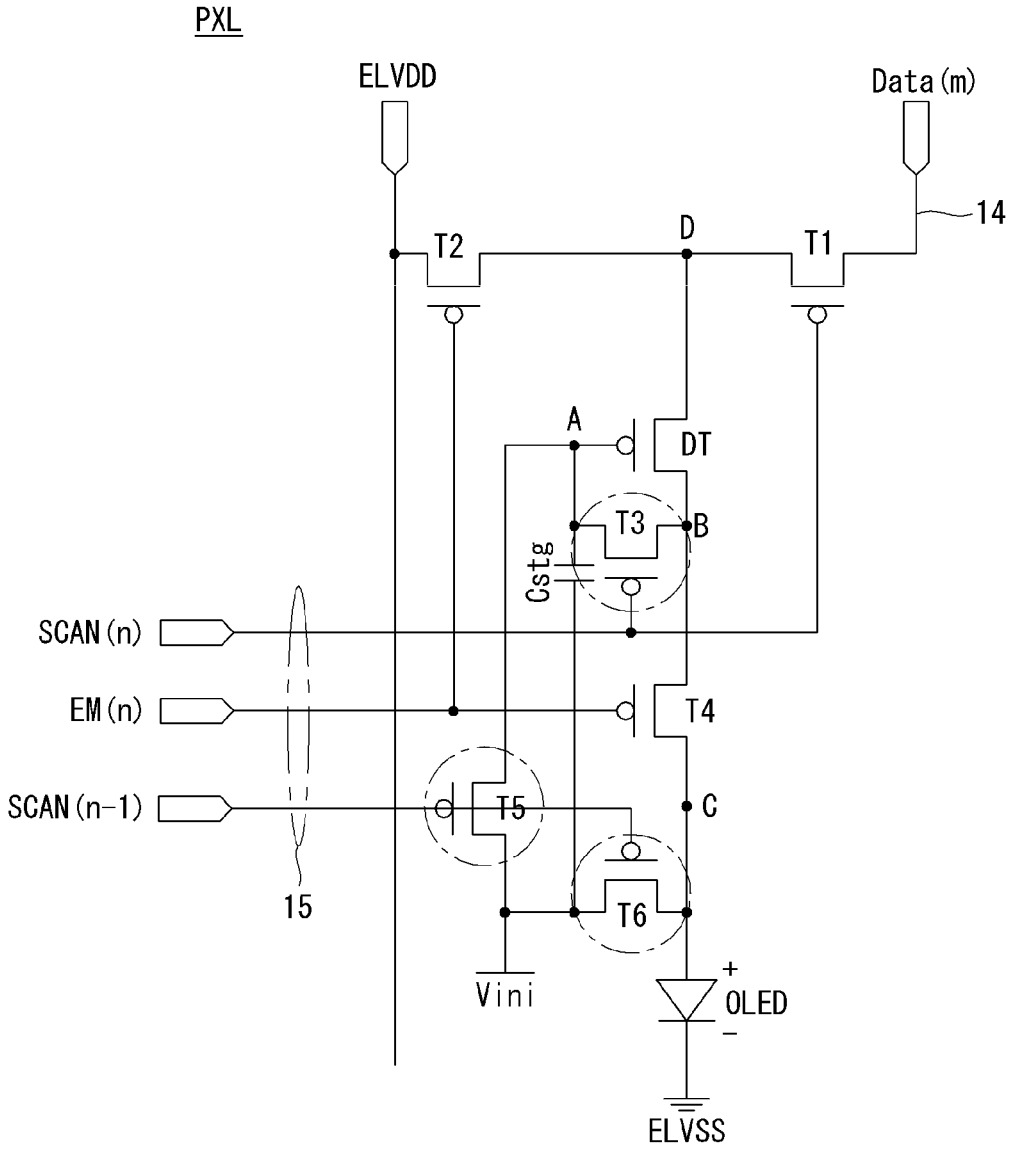
FIG. 7 is an equivalent circuit diagram showing a modification of the pixel structure of FIG. 3.
Figure 11:
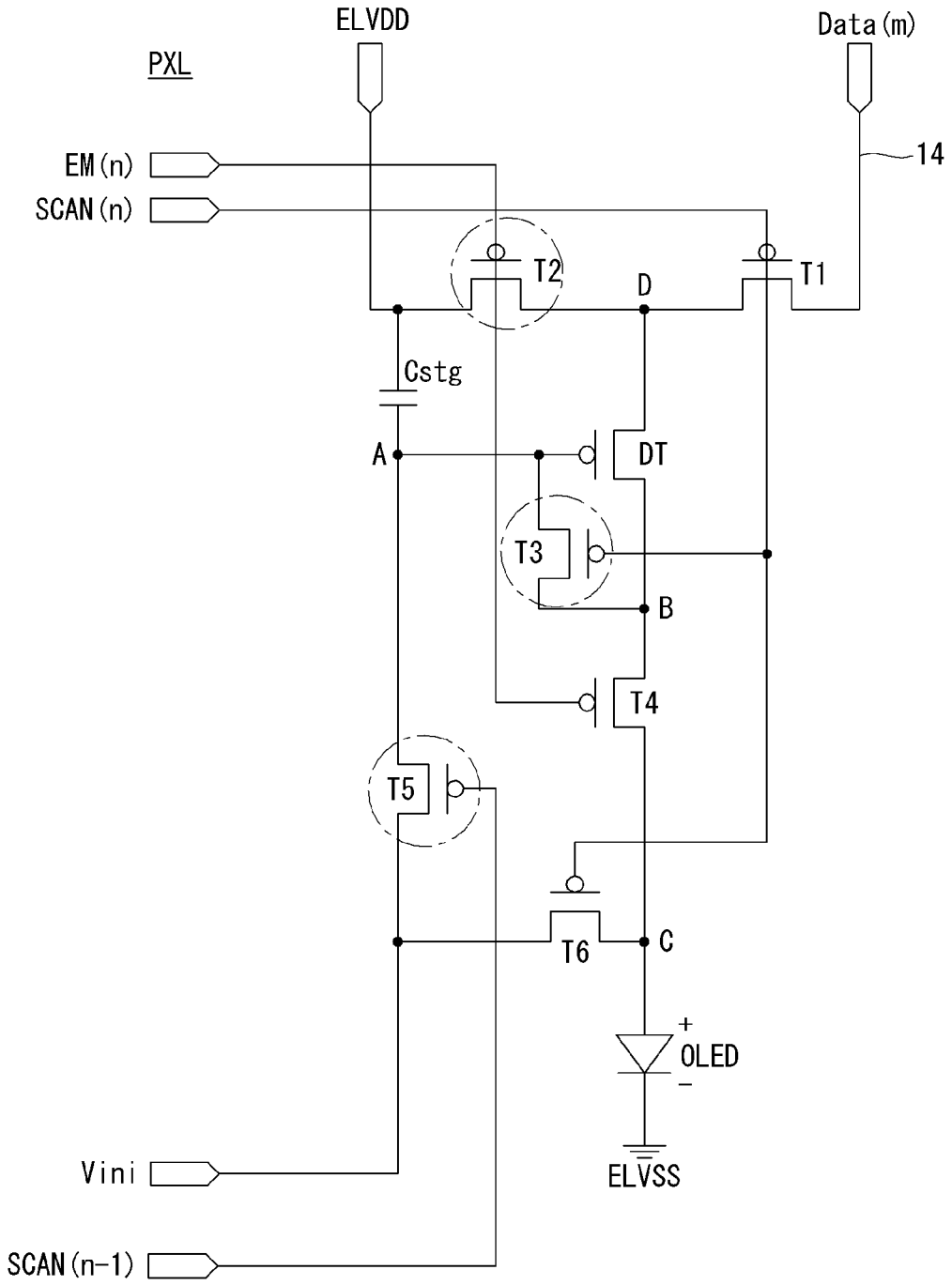
FIG. 11 is an equivalent circuit diagram showing a modification of the pixel structure of FIG. 7.
Figure 12:
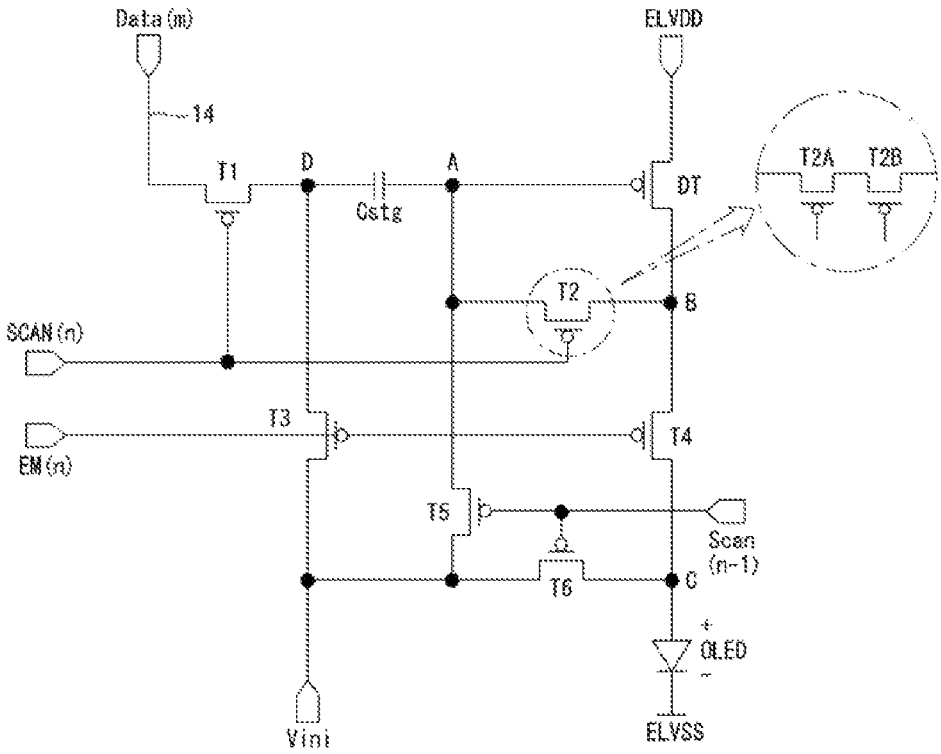
FIG. 12 is an equivalent circuit diagram showing a modification of the pixel structure of FIG. 3.

As shown in FIG. 7, the sixth transistor T6, as well as the third transistor T3 and the fifth transistor T5, may be designed as a double-gate transistor comprising T6A and T6B. Also, as shown in FIG. 11, the second transistor T2, as well as the third transistor T3 and the fifth transistor T5, may be designed as a double-gate transistor comprising T2A and T2B. Also, as shown in FIG. 12, the second transistor T2 may be designed as a double-gate transistor comprising T2A and T2B.

That is, at least one of the transistors connected to the capacitor may comprise two series-connected transistors, so as to prevent distortion in luminescence intensity caused by leakage current.

Referring again to FIG. 2, the timing controller 11 realigns digital video data RGB input from an external source to match the resolution of the display panel 10 and supplies it to the data drive circuit 12. Also, the timing controller 11 generates a data control signal DDC for controlling the operation timing of the data drive circuit 12 and a gate control signal GDC for controlling the operation timing of the gate drive circuit 13, based on timing signals such as a vertical synchronization signal Vsync, a horizontal synchronization signal Hsync, a dot clock signal DCLK, and a data enable signal DE.

The data drive circuit 12 converts the digital video data RGB input from the timing controller 11 to an analog data voltage based on the data control signal DDC.

The gate drive circuit 13 generates a scan signal and an emission signal based on the gate control signal GDC. The gate drive circuit 13 may comprise a scan driver and an emission driver. The scan driver may generate a scan signal and provide it to the scan lines on a line-sequential basis, in order to drive at least one scan line connected to each pixel row. The emission driver may generate an emission signal and provide it to the emission lines, in order to drive at least one emission line connected to each pixel row.

The gate drive circuit 13 may be formed directly in a non-display area of the display panel 10 according to the GIP (gate-driver In Panel) technology.

Figure 4:
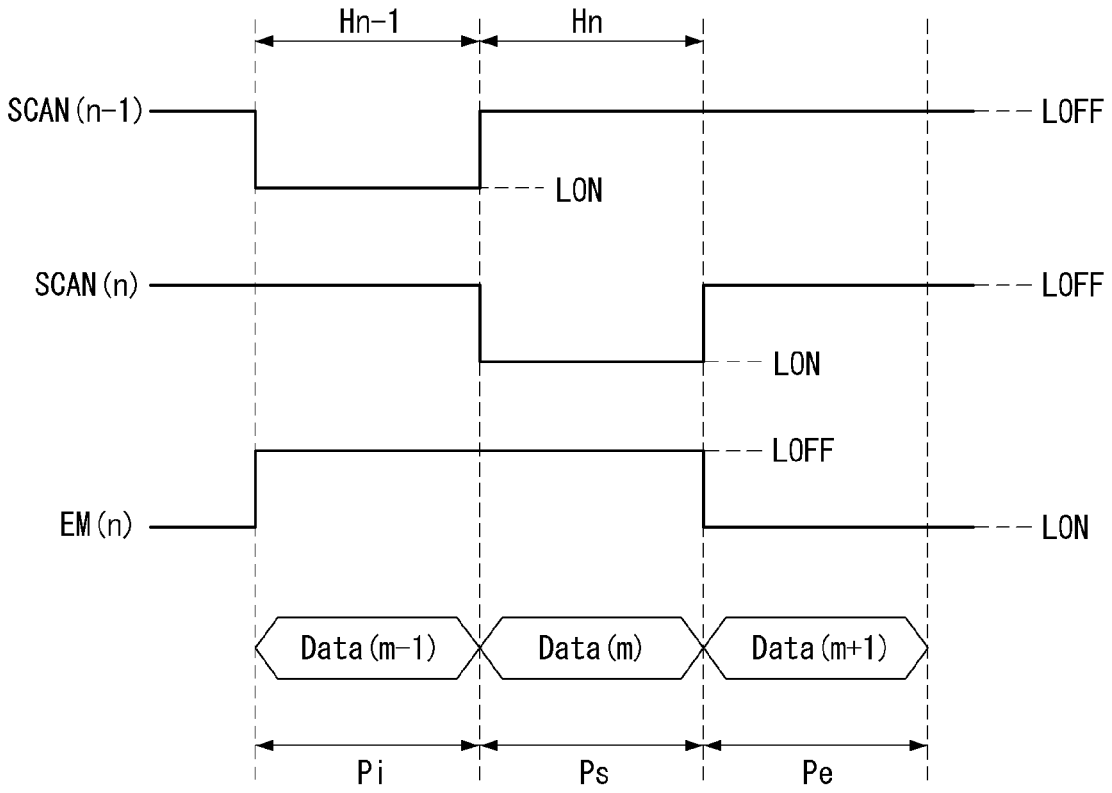
FIG. 4 is a waveform diagram showing data signals and gate signals which are applied to the pixel of FIG. 3.

FIG. 3 is an equivalent circuit diagram of a pixel structure according to the present disclosure. FIG. 4 is a waveform diagram showing data signals and gate signals which are applied to the pixel of FIG. 3.

Referring to FIG. 3, each pixel PXL arranged in an nth row (n is a natural number) comprises an organic light emitting diode OLED, a driving transistor DT, a first transistor T1, a second transistor T2, a third transistor T3, a fourth transistor T4, a fifth transistor T5, and a capacitor Cstg.

The organic light emitting diode OLED emits light by a driving current supplied from the driving transistor DT. The organic light emitting diode OLED comprises multiple layers of organic compounds between an anode and a cathode. The organic compound layers may comprises at least one among a hole transfer layer, an electron transfer layer, and an emission layer EML. The hole transfer layer includes a layer that injects or transfers holes into the emission layer, for example, a hole injection layer HIL, a hole transport layer HTL, an electron blocking layer EBL, etc. The electron transfer layer includes a layer that injects or transfers electrons into the emission layer, for example, an electron transport layer ETL, an electron injection layer EIL, a hole blocking layer HBL, etc. The anode of the organic light emitting diode OLED is connected to a node C, and the cathode of the organic light emitting diode OLED is connected to an input terminal of the low-level driving voltage ELVSS.

The driving transistor DT controls an amount of driving current applied to the organic light emitting diode OLED based on its source-gate voltage Vsg. The gate electrode of the driving transistor DT is connected to a node A, its source electrode is connected to a node D, and its drain electrode is connected to a node B.

The first transistor T1 is connected between a data line 14 and the node D, and is turned on/off in response to an nth scan signal SCAN(n). The gate electrode of the first transistor T1 is connected to an nth scan line to which the nth scan signal SCAN(n) is applied, the source electrode of the first transistor T1 is connected to the data line 14, and the drain electrode of the first transistor T1 is connected to the node D.

The second transistor T2 is connected between the node D and an input terminal of the high-level driving voltage ELVDD, and is turned on/off in response to an nth emission signal EM(n). The gate electrode of the second transistor T2 is connected to an nth emission line to which the nth emission signal EM(n) is applied, the source electrode of the second transistor T2 is connected to the input terminal of the high-level driving voltage ELVDD, and the drain electrode of the second transistor T2 is connected to the node D.

The third transistor T3 is connected to the node A and the node B, and is turned on/off in response to the nth scan signal SCAN(n). The gate electrode of the third transistor T3 is connected to the nth scan line to which the nth scan signal SCAN(n) is applied, the source electrode of the third transistor T3 is connected to the node A, and the drain electrode of the third transistor T3 is connected to the node B. Here, the third transistor T3 may be referred to as a sampling transistor.

The fourth transistor T4 is connected between the node B and the node C, and is turned on/off in response to the nth emission signal EM(n). The gate electrode of the fourth transistor T4 is connected to the nth emission line to which the nth emission signal EM(n) is applied, the source electrode of the fourth transistor T4 is connected to the node B, and the drain electrode of the fourth transistor T4 is connected to the node C. Here, the fourth transistor T4 may be referred to as an emission transistor.

The fifth transistor T5 is connected between the node A and an input terminal of the initial voltage Vini, and is turned on/off in response to an (n−1)th scan signal SCAN(n−1). The gate electrode of the fifth transistor T5 is connected to the (n−1)th first scan line to which the (n−1)th scan signal SCAN(n−1) is applied, the source electrode of the fifth transistor T5 is connected to the node A, and the drain electrode of the fifth transistor T5 is connected to the input terminal of the initial voltage Vini. Here, the fifth transistor T5 may be referred to as a first initial transistor.

The capacitor Cstg is connected between the node A and the input terminal of the initial voltage Vini.

Figure 5A:
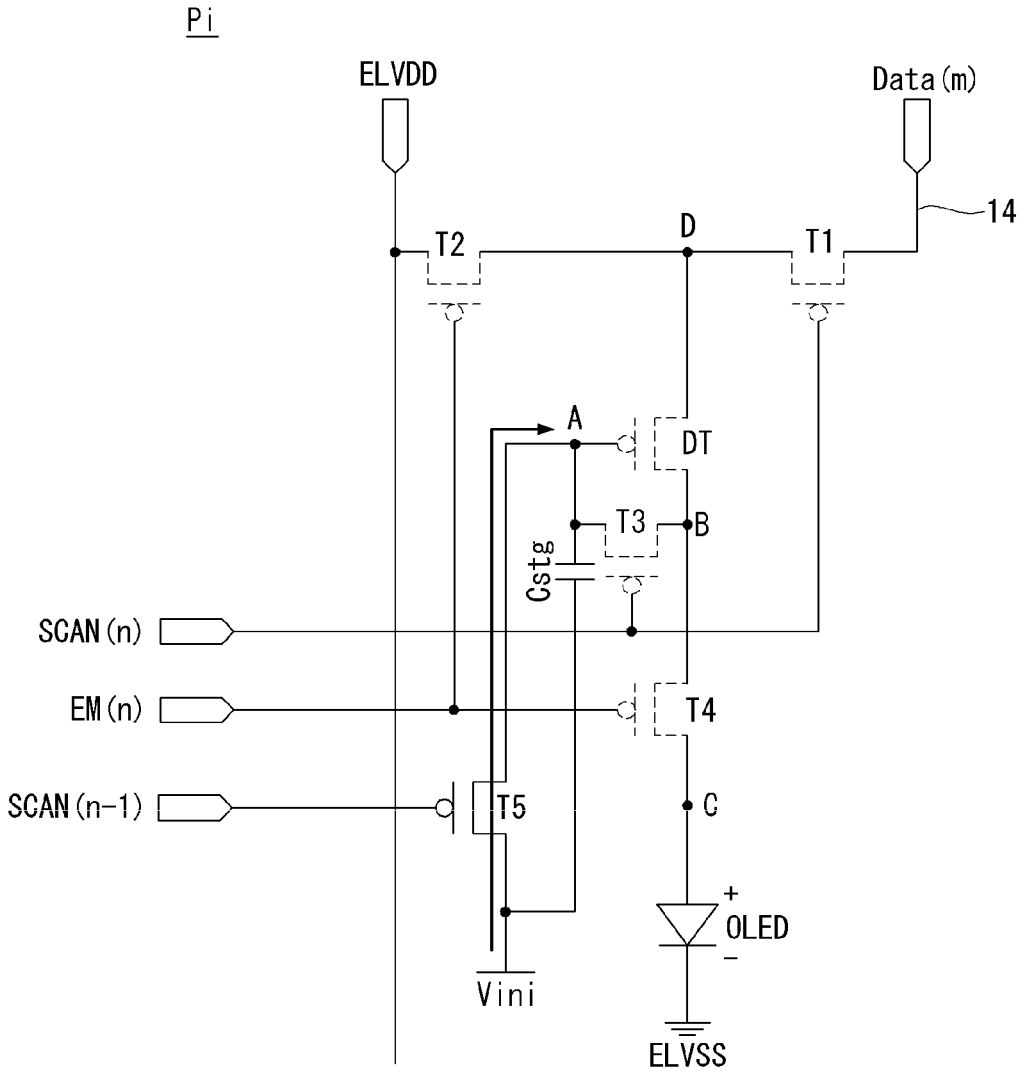
FIGS. 5A, 5B, and 5C are equivalent circuit diagrams of the pixel corresponding to the initial period, sampling period, and emission period of FIG. 4.
Figure 5B:
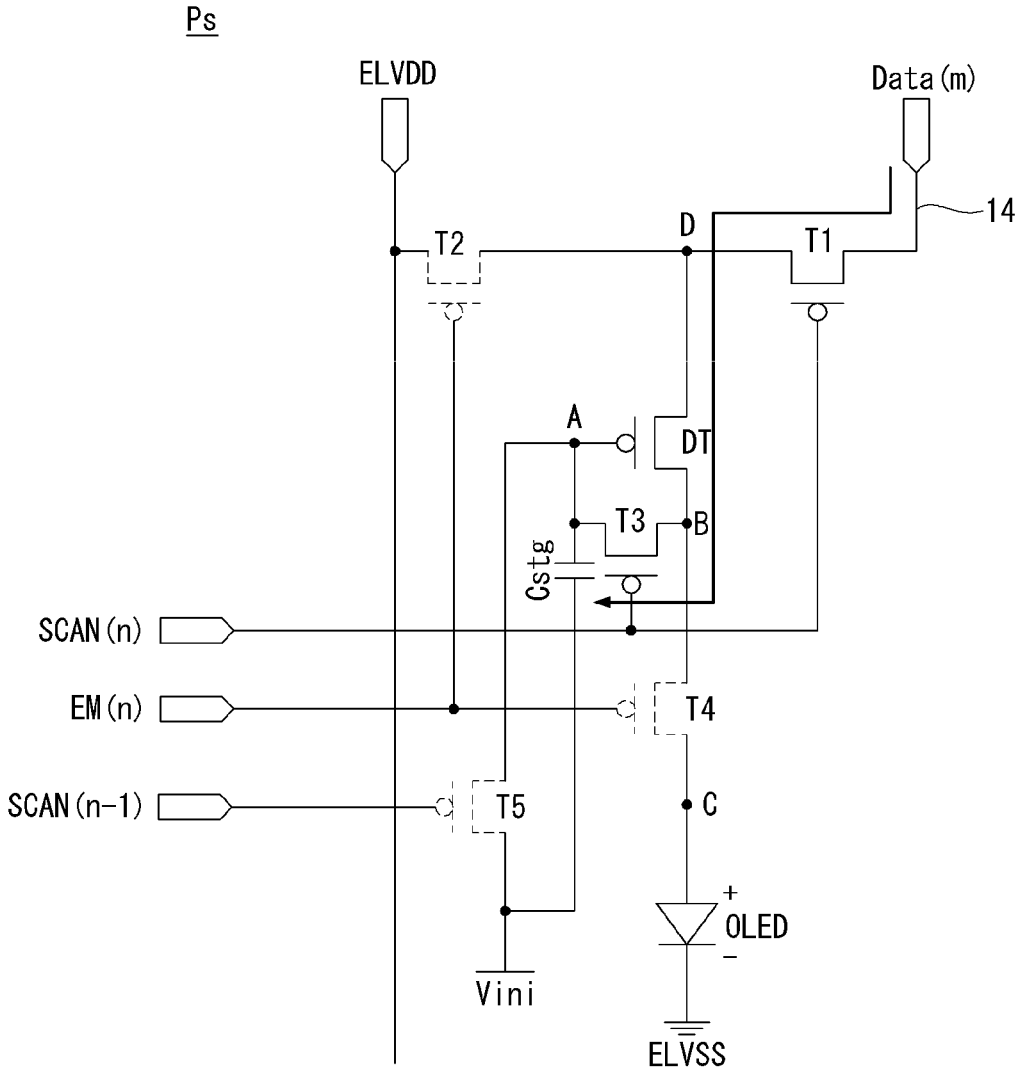
Figure 5C:
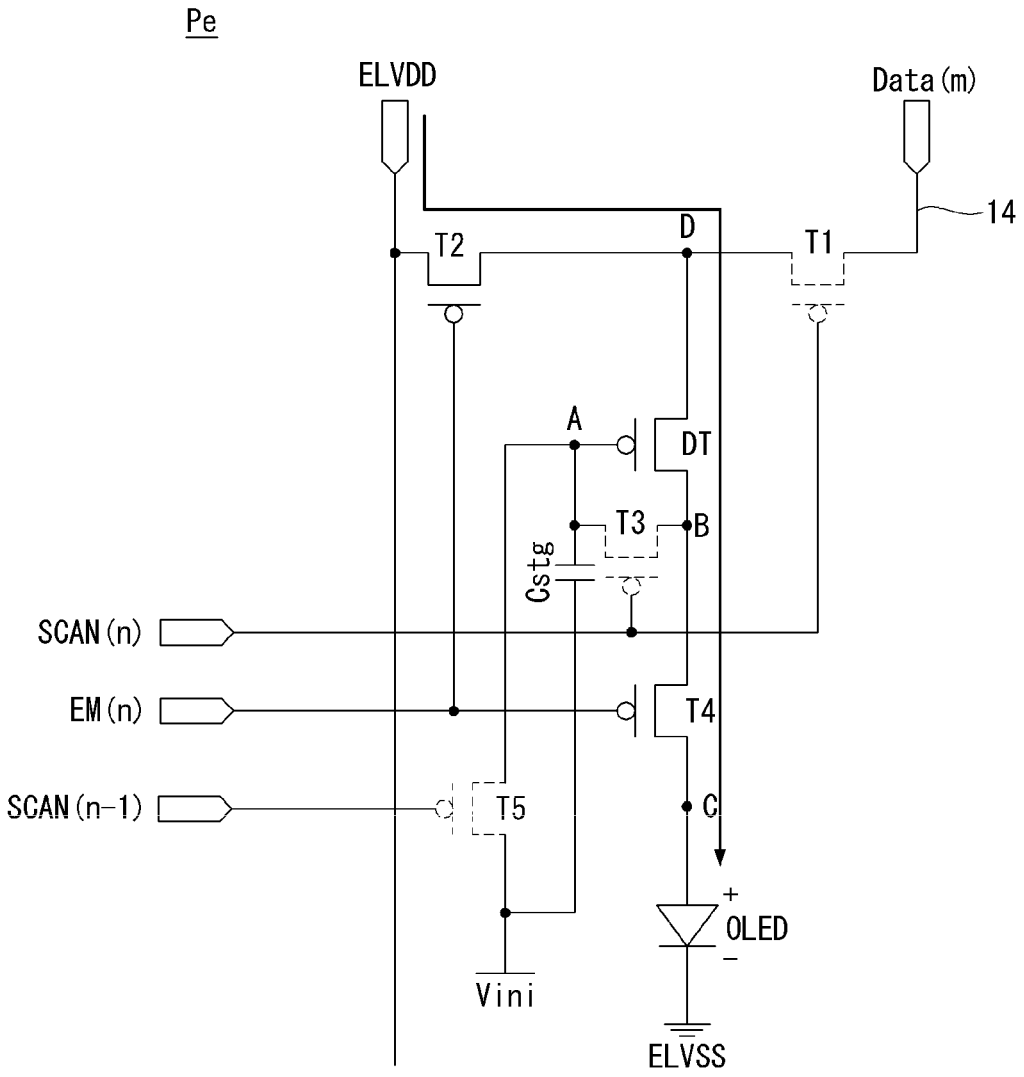

Referring to FIGS. 4 to 6, the operation of the pixel of FIG. 3 will be described. FIG. 4 is a waveform diagram showing data signals and gate signals which are applied to the pixel of FIG. 3. FIGS. 5A, 5B, and 5C are equivalent circuit diagrams of the pixel corresponding to the initial period, sampling period, and emission period of FIG. 4. FIG. 6 is a view showing the voltages for nodes A, B, and C of the pixel during the initial period, the sampling period, and the emission period.

As shown in FIG. 4, one frame may be divided into an initial period Pi in which the node A is initialized, a sampling period Ps in which the threshold voltage of the driving transistor DT is sampled and stored at the node A, an emission period Pe in which the source-gate voltage of the driving transistor DT is programmed (or adjusted) according to the sampled threshold voltage, and the organic light emitting diode OLED emits light by a driving current corresponding to the programmed source-gate voltage. In FIG. 4, since an initial operation is performed during an (n−1)th horizontal period Hn−1, an nth horizontal period Hn may be entirely spent on a sampling operation. This ensures a sufficient sampling period Ps, thus making it possible to sample the threshold voltage of the driving transistor more accurately. The Data(m−1), Data(m) and Data(m+1) refer to the (m−1)th, (m)th, and (m+1)th data signal respectively.

In FIG. 5A, the transistors that operate (are turned on) during the initial period Pi are indicated by the solid lines, and the transistors that do not operate (are turned off) during this period are indicated by the dotted lines. Referring to FIGS. 4 and 5A, the initial period Pi lasts for an (n−1)th horizontal period Hn−1 allocated for data writing in an (n−1)th row. In the initial period Pi, the (n−1)th scan signal SCAN(n−1) is applied at low level, and the nth scan signal SCAN(n) and the nth emission signal EM(n) are applied at high level. Here, the low level is an ON level LON, and the high level is an OFF level LOFF. For convenience of explanation, the low level will be hereinafter referred to as an ON level and the high level as an OFF level.

In the initial period Pi, as the fifth transistor T5 is turned on in response to the (n−1)th scan signal SCAN(n−1), the node A is initialized to the initial voltage Vini. Here, the fifth transistor T5 may be referred to as a first initial transistor. As the gate electrode of the first initial transistor T5 is connected to the (n−1)th scan line to which the (n−1)th scan signal SCAN(n−1) is applied, a sufficient sampling period may be allowed to sample the threshold voltage Vth of the driving transistor DT, thus improving the accuracy of compensation of the threshold voltage Vth. By thus initializing the node A prior to the sampling operation, the sampling reliability can be improved, and unnecessary light emission by the organic light emitting diode OLED can be avoided. To this end, the initial voltage Vini may be chosen from a range of voltages lower than operating voltage of the organic light emitting diode OLED, and the initial voltage Vini may be set equal to or lower than the low-level driving voltage ELVSS. Also, the node D holds the data voltage Vdata(n) of the previous frame during the initial period Pi.

In FIG. 5B, the transistors that operate during the sampling period Ps are indicated by the solid lines, and the transistors that do not operate during this period are indicated by the dotted lines. Referring to FIGS. 4 and 5B, the sampling period Ps lasts for an nth horizontal period Hn allocated for data writing in an nth row. In the sampling period Ps, the nth scan signal SCAN(N) is applied at an ON level, and the (n−1)th scan signal SCAN(n−1) and the nth emission signal EM(n) are applied at an OFF level. In the sampling period Ps, as the first and third transistors T1 and T3 turn on in response to the nth scan signal SCAN(n), the driving transistor DT is diode-connected (that is, the gate electrode and the drain electrode are shorted so that the driving transistor DT acts as a diode), and the data voltage Vdata(n) is applied to the node D.

In the sampling period Ps, a current Ids flows between the source electrode and drain electrode of the driving transistor DT, and this current Ids causes the voltage at the node A to rise from the initial voltage Vini to Vdata(n)−Vth, obtained by subtracting the threshold voltage of the driving transistor DT from the data voltage Vdata(n). The initial voltage Vini is equal to or lower than the low-level driving voltage ELVSS. As the voltage at the node A, which is connected to the gate electrode of the driving transistor DT, is adjusted according to the threshold voltage Vth of the driving transistor DT, a driving current may be generated in a subsequent emission period Pe, irrespective of the threshold voltage Vth of the driving transistor DT.

In FIG. 5C, the transistors that operate during the emission period Pe are indicated by the solid lines, and the transistors that do not operate during this period are indicated by the dotted lines. Referring to FIGS. 4 and 5C, the emission period Pe corresponds to the remaining portion of one frame, excluding the initial period Pi and the sampling period Ps. In the emission period Pe, the nth emission signal EM(n) is applied at an ON level, and the (n−1)th scan signal SCAN(n−1) and the nth scan signal SCAN(n) are applied at an OFF level.

In the emission period Pe, as the second transistor T2 is turned on in response to the nth emission signal EM(n), the high-level driving voltage ELVDD is connected to the source electrode of the driving transistor DT. Also, as the fourth transistor T4 is turned on in response to the nth emission signal EM(n), the voltage across the nodes B and C becomes substantially equal to the operating voltage Voled of the organic light emitting diode OLED.

The fourth transistor T4 is connected to the anode of the organic light emitting diode OLED and is turned off during the initial period Pi and the sampling period Ps, but not during the emission period Pe, thus preventing a leakage current flowing through the organic light emitting diode OLED at times other than the emission period Pe. Here, the fourth transistor T4 may be referred to as an emission transistor.

The relational expression for the driving current Ioled flowing through the organic light emitting diode OLED during the emission period Pe is represented by the following Equation 1. The organic light emitting diode OLED emits light by a driving current, thereby displaying a desired gray level.

$$I_{oled}=k/2(Vsg-Vth)^2=k/2(Vs-Vg-Vth)^2=k/2(VDD-V\text{data}+Vth-Vth)^2=k/2(VDD-V\text{data})^2 \quad \text{[Equation 1]}$$

where k/2 indicates a proportional constant determined by the electron mobility, parasitic capacitance, and channel capacity of the driving transistor DT.

The mathematical expression for the driving current Ioled is $k/2(Vsg-Vth)^2$. Vsg, which is programmed in the emission period Pe, is already adjusted according to the threshold voltage component Vth of the driving transistor DT. Thus, the threshold voltage component Vth of the driving transistor DT does not affect the driving current Ioled, according to the relational expression, as shown in Equation 1. This minimizes the effect of a change in threshold voltage Vth on the driving current Ioled.

FIG. 6 shows a table of voltages that are applied to the nodes A, B, and C during the initial, sampling, and emission periods Pi, Ps, and Pe explained in FIGS. 5A to 5C. After passing through the sampling period Ps, a voltage of the node A is adjusted according to the threshold voltage Vth of the driving transistor DT, and when the organic light emitting diode OLED emits light in the emission period Pe, the driving current Ioled of the driving transistor DT allows for displaying a desired gray level, irrespective of the threshold voltage Vth of the driving transistor DT.

Figure 8:
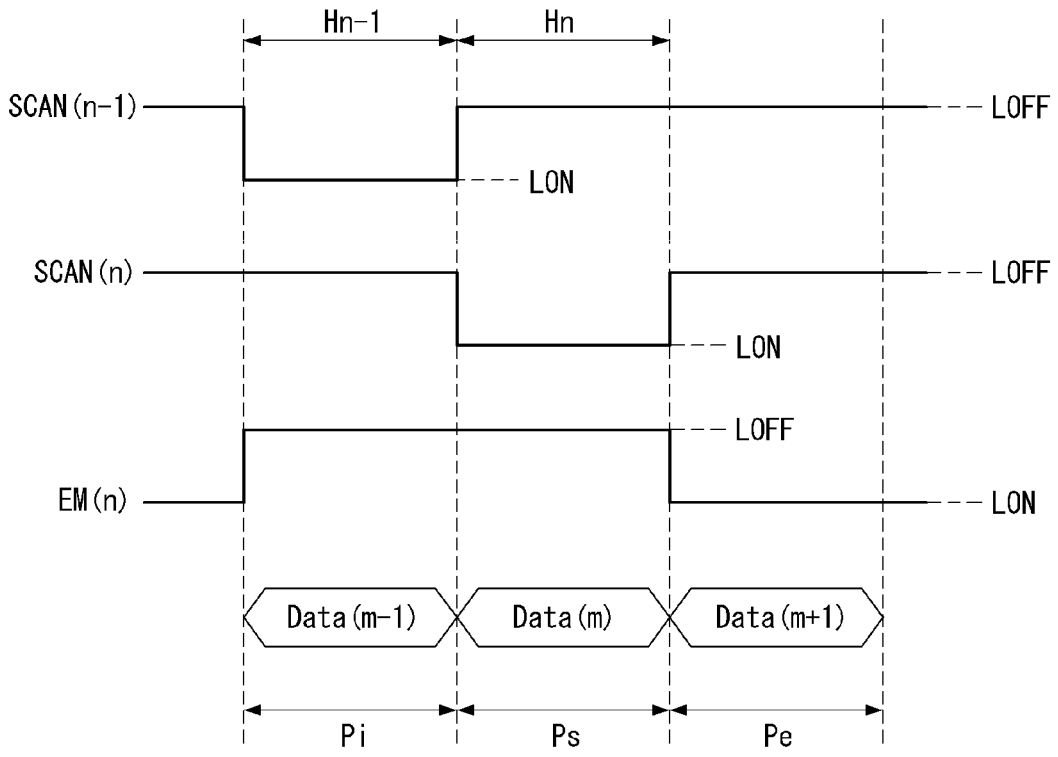
FIG. 8 is a waveform diagram showing data signals and gate signals which are applied to the pixel of FIG. 7.
Figure 9A:
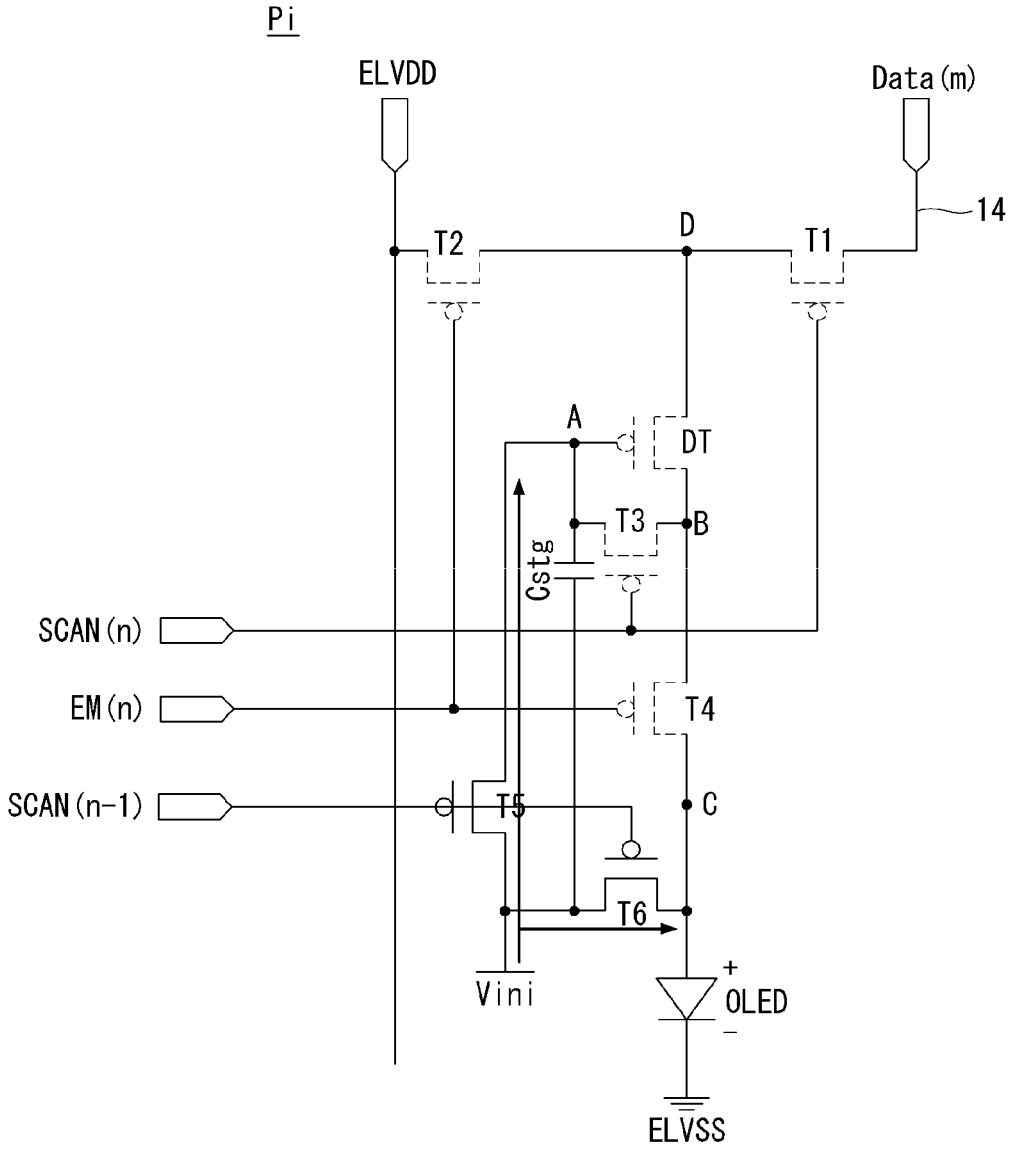
FIGS. 9A, 9B, and 9C are equivalent circuit diagrams of the pixel corresponding to the initial period, sampling period, and emission period of FIG. 7.
Figure 9B:
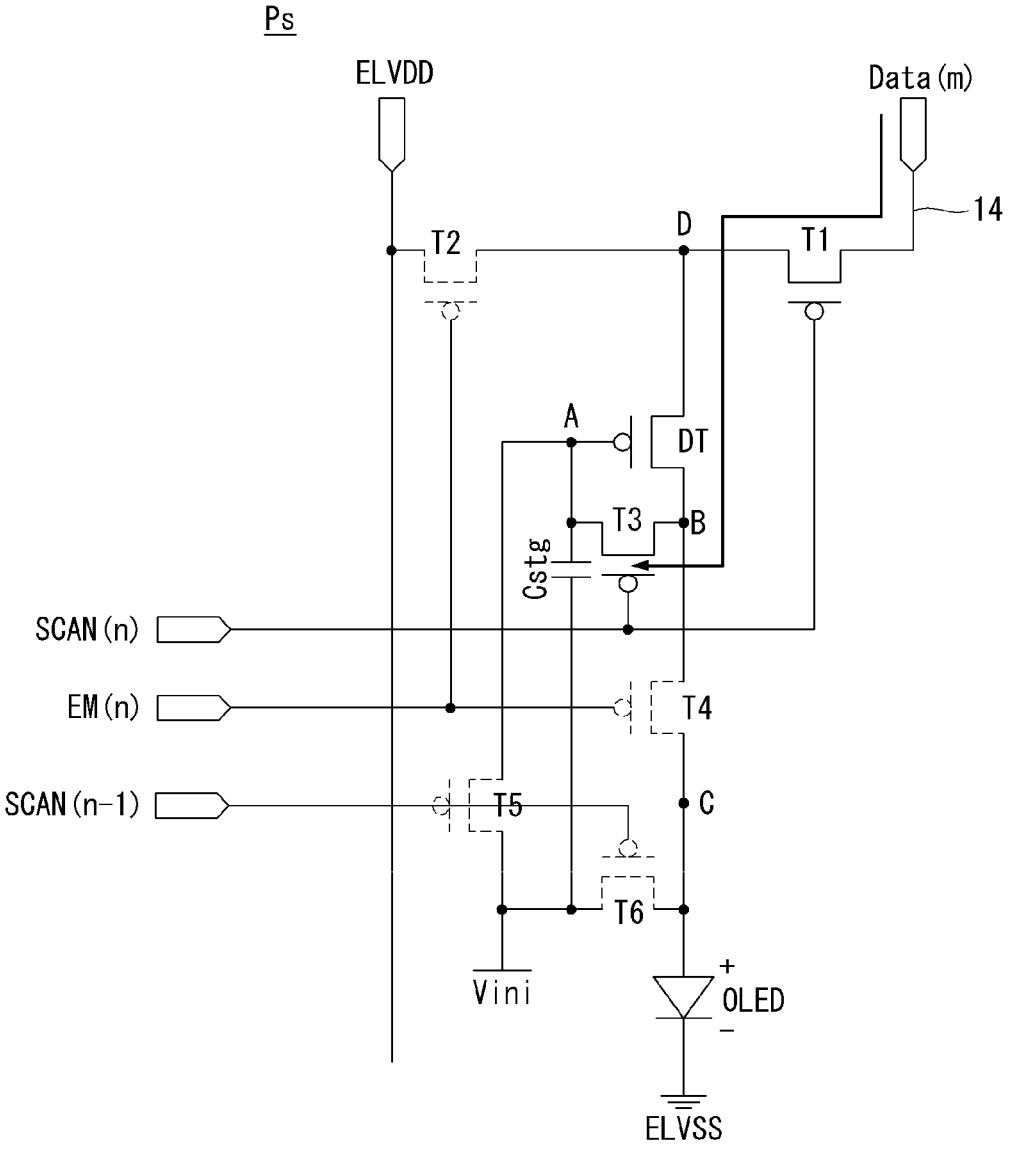
Figure 9C:
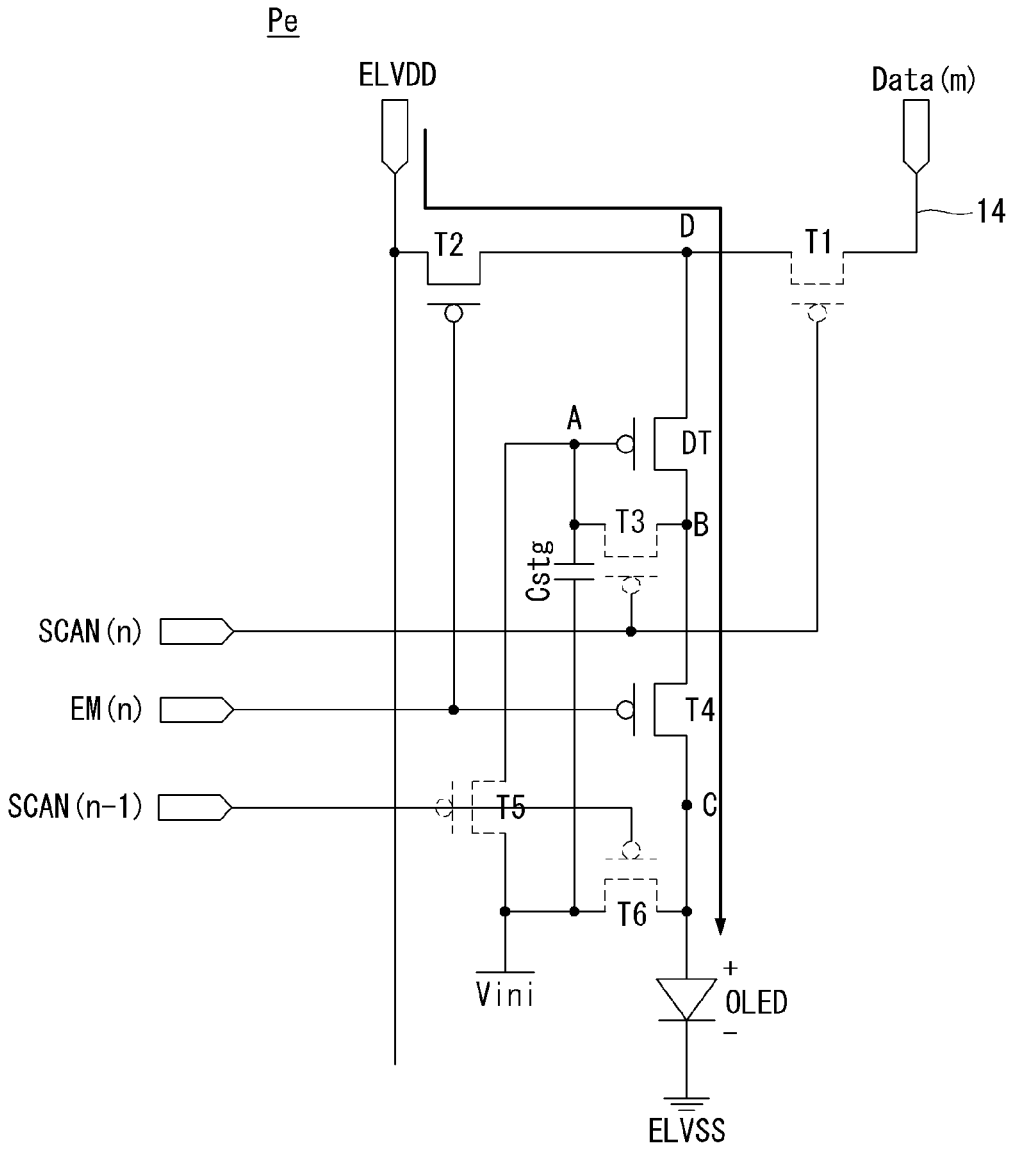

FIG. 7 is an equivalent circuit diagram showing a modification embodiment of the pixel structure of FIG. 3. FIG. 8 is a waveform diagram showing data signals and gate signals which are applied to the pixel of FIG. 7. FIGS. 9A, 9B, and 9C are equivalent circuit diagrams of the pixel corresponding to an initial period, a sampling period, and an emission period of FIG. 7. FIG. 10 is a view showing the voltages for nodes A, B, and C of the pixel during the initial period, the sampling period, and the emission period.

The pixel PXL of FIG. 7 further comprises a sixth transistor T6, in addition to the elements of the pixel PXL of FIG. 3. In the pixel PXL of FIG. 7, the sixth transistor T6 is connected between the input terminal of the initial voltage Vini and the node C. A gate electrode of the sixth transistor T6 is connected to an (n−1)th first scan line to which the (n−1)th scan signal SCAN(N−1) is applied, a source electrode of the sixth transistor T6 is connected to the node C, and a drain electrode of the sixth transistor T6 is connected to the input terminal of the initial voltage Vini. By adding the sixth transistor T6 as shown in FIG. 7, the voltage at the node C can be fixed, thereby improving the sampling accuracy. Accordingly, the stability of circuit operation can be improved. Here, the sixth transistor T6 may be referred to as a second initial transistor.

All the other elements of FIG. 7 except the sixth transistor T6 are substantially identical to those explained with reference to FIG. 3.

A description of how the pixel of FIG. 7 works will be made with reference to FIGS. 7 to 10. FIG. 8 is a waveform diagram showing data signals and gate signals which are applied to the pixel of FIG. 7. FIGS. 9A, 9B, and 9C are equivalent circuit diagrams of the pixel corresponding to the initial period, the sampling period, and the emission period of FIG. 7. FIG. 10 is a view showing the voltages for nodes A, B, and C of the pixel during the initial period, the sampling period, and the emission period.

As shown in FIG. 8, one frame may be divided into an initial period Pi in which the node A and the node C are initialized, a sampling period Ps in which the threshold voltage of the driving transistor DT is sampled and stored at the node A, an emission period Pe in which the source-gate voltage of the driving transistor DT is programmed (or adjusted) according to the sampled threshold voltage, and the organic light emitting diode OLED emits light by a driving current corresponding to the programmed source-gate voltage. In FIG. 8, since an initial operation is performed during an (n−1)th horizontal period Hn−1, an nth horizontal period Hn may be entirely spent on a sampling operation. This ensures a sufficient sampling period Ps, thus making it possible to sample the threshold voltage of the driving transistor more accurately.

In FIG. 9A, the transistors that operate during the initial period Pi are indicated by the solid lines, and the transistors that do not operate during this period are indicated by the dotted lines. Referring to FIGS. 8 and 9A, in the initial period Pi, the (n−1)th scan signal SCAN(n−1) is applied at an ON level, and the nth scan signal SCAN(n) and the nth emission signal EM(n) are applied at an OFF level. In the initial period Pi, as the fifth and sixth transistors T5 and T6 turn on in response to the (n−1)th scan signal SCAN(n−1), the node A and the node C are initialized to the initial voltage Vini. As the gate electrodes of the fifth and sixth transistors T5 and T6 are connected to the (n−1)th scan line to which the (n−1)th scan signal SCAN(n−1) is applied, a sufficient sampling period may be allowed to sample the threshold voltage Vth of the driving transistor DT, thus improving the accuracy of compensation of the threshold voltage Vth. In other words, by initializing the node A and the node C prior to the sampling operation, the sampling reliability can be improved, and unnecessary light emission by the organic light emitting diode OLED can be avoided.

In FIG. 9B, the transistors that operate during the sampling period Ps are indicated by the solid lines, and the transistors that do not operate during this period are indicated by the dotted lines. Referring to FIGS. 8 and 9B, in the sampling period Ps, the nth scan signal SCAN(N) is applied at an ON level, and the (n−1)th scan signal SCAN(n−1) and the nth emission signal EM(n) are applied at an OFF level. In the sampling period Ps, as the first and third transistors T1 and T3 turn on in response to the nth scan signal SCAN(n), the driving transistor DT is diode-connected (that is, the gate electrode and the drain electrode are shorted so that the driving transistor DT acts as a diode), and the data voltage Vdata(n) is applied to the node D.

Accordingly, in the sampling period Ps, a current Ids flows between the source electrode and drain electrode of the driving transistor DT, and this current Ids causes the voltage at the node A to rise from the initial voltage Vini to Vdata(n)−Vth, obtained by subtracting the threshold voltage of the driving transistor DT from the data voltage Vdata(n). The initial voltage Vini is equal to or lower than the low-level driving voltage ELVSS. As the voltage at the node A, which is connected to the gate electrode of the driving transistor DT, is adjusted according to the threshold voltage Vth of the driving transistor DT, a driving current may be generated in a subsequent emission period Pe, irrespective of the threshold voltage Vth of the driving transistor DT.

In FIG. 9C, the transistors that operate during the emission period Pe are indicated by the solid lines, and the transistors that do not operate during this period are indicated by the dotted lines. Referring to FIGS. 8 and 9C, in the emission period Pe, the nth emission signal EM(n) is applied at an ON level, and the (n−1)th scan signal SCAN(n−1) and the nth scan signal SCAN(n) are applied at an OFF level. In the emission period Pe, as the second transistor T2 is turned on in response to the nth emission signal EM(n), the high-level driving voltage ELVDD is connected to the source electrode of the driving transistor DT. Also, as the fourth transistor T4 is turned on in response to the nth emission signal EM(n), the voltage across the nodes B and C becomes substantially equal to the operating voltage Voled of the organic light emitting diode OLED.

The fourth transistor T4 is connected to the anode of the organic light emitting diode OLED and is turned off during the initial period Pi and the sampling period Ps, but not during the emission period Pe, thus preventing a leakage current flowing through the organic light emitting diode OLED at times other than the emission period Pe. The relational expression for the driving current Ioled flowing through the organic light emitting diode OLED during the emission period Pe is represented by the following Equation 2. The organic light emitting diode OLED emits light according to a driving current, thereby displaying a desired gray level.

$$I_{oled}=k/2(Vsg-Vth)^2=k/2(Vs-Vg)-Vth)^2=k/2((VDD-Vdata+Vth)-Vth)^2=k/2(VDD-Vdata)^2 \quad \text{[Equation 2]}$$

where k/2 indicates a proportional constant determined by the electron mobility, parasitic capacitance, and channel capacity of the driving transistor DT.

The mathematical expression for the driving current Ioled is $k/2(Vsg-Vth)^2$. Vsg, which is programmed in the emission period Pe, is already adjusted according to the threshold voltage Vth of the driving transistor DT. Thus, the threshold voltage Vth of the driving transistor DT does not affect the driving current Ioled, according to the relational expression, as shown in Equation 2. This minimizes the effect of a change in threshold voltage Vth on the driving current Ioled.

FIG. 10 shows a table of voltages that are applied to the nodes A, B, and C during the initial, sampling, and emission periods Pi, Ps, and Pe explained in FIGS. 9A to 9C. After the sampling period Ps, the a voltage at node A is adjusted according to the threshold voltage Vth of the driving transistor DT, and when the organic light emitting diode OLED emits light in the emission period Pe, the driving current Ioled of the driving transistor DT allows for displaying a desired gray level, irrespective of the threshold voltage Vth of the driving transistor DT.

FIG. 11 is an equivalent circuit diagram showing a modification embodiment of the pixel structure of FIG. 7. FIG. 11 shows a modification of the connection relationship among the second transistor T2, third transistor T3, and fifth transistor T5 shown in FIG. 7.

The driving transistor DT controls an amount of driving current applied to the organic light emitting diode OLED based on its source-gate voltage Vsg. The gate electrode of the driving transistor DT is connected to a node A, the source electrode of the driving transistor DT is connected to a node D, and the drain electrode of the driving transistor DT is connected to a node B.

The first transistor T1 is connected to a data line 14 and the node D, and is turned on/off in response to an nth scan signal SCAN(n). The gate electrode of the first transistor T1 is connected to an nth scan line to which the nth scan signal SCAN(n) is applied, the source electrode of the first transistor T1 is connected to the data line 14, and the drain electrode of the first transistor T1 is connected to the node D.

The second transistor T2 is connected between the node D and an input terminal of the high-level driving voltage ELVDD, and is turned on/off in response to an nth emission signal EM(n). The gate electrode of the second transistor T2 is connected to an nth emission line to which the nth emission signal EM(n) is applied, the source electrode of the second transistor T2 is connected to the input terminal of the high-level driving voltage ELVDD, and the drain electrode of the second transistor T2 is connected to the node D.

The third transistor T3 is connected to the node A and the node B, and is turned on/off in response to the nth scan signal SCAN(n). The gate electrode of the third transistor T3 is connected to the nth scan line to which the nth scan signal SCAN(n) is applied, the source electrode of the third transistor T3 is connected to the node B, and the drain electrode of the third transistor T3 is connected to the node A.

The fourth transistor T4 is connected to the node B and the node C, and is turned on/off in response to the nth emission signal EM(n). The gate electrode of the fourth transistor T4 is connected to the nth emission line to which the nth emission signal EM(n) is applied, the source electrode of the fourth transistor T4 is connected to the node B, and the drain electrode of the fourth transistor T4 is connected to the node C.

The fifth transistor T5 is connected between the node A and an input terminal of the initial voltage Vini, and is turned on/off in response to an (n−1)th scan signal SCAN(n−1). The gate electrode of the fifth transistor T5 is connected to the (n−1)th first scan line to which the (n−1)th scan signal SCAN(n−1) is applied, the drain electrode of the fifth transistor T5 is connected to the node A, and the source electrode of the fifth transistor T5 is connected to the input terminal of the initial voltage Vini.

The sixth transistor T6 is connected between the input terminal of the initial voltage Vini and the node C, and is turned on/off in response to the nth scan signal SCAN(n). The gate electrode of the sixth transistor T6 is connected to the nth scan line to which the nth scan signal SCAN(n) is applied, the source electrode of the sixth transistor T6 is connected to the node C, and the drain electrode of the sixth transistor T6 is connected to the input terminal of the initial voltage Vini.

The capacitor Cstg is connected between the node A and the input terminal of the initial voltage Vini.

The waveform diagram in FIG. 8 is also adjusted in the equivalent circuit diagram of FIG. 11. As shown in FIG. 8, one frame may be divided into an initial period Pi in which the node A and the node C are initialized, a sampling period Ps in which the threshold voltage of the driving transistor DT is sampled and stored at the node A, an emission period Pe in which the source-gate voltage of the driving transistor DT is programmed (or adjusted) according to the sampled threshold voltage, and the organic light emitting diode OLED emits light by a driving current corresponding to the programmed source-gate voltage. The gate voltage of the driving transistor DT is initialized during an (n−1)th horizontal period Hn−1, and a sampling operation, along with the initializing of the organic light emitting diode OLED, is performed during an nth horizontal period Hn. That is, the initial period Pi and the sampling period Ps are included in the nth horizontal period Hn.

In the initial period Pi, the (n−1)th scan signal SCAN(n−1) is applied at an ON level, and the nth scan signal SCAN(n) and the nth emission signal EM(n) are applied at an OFF level. In the initial period Pi, as the fifth transistor T5 is turned on in response to the (n−1)th scan signal SCAN(n−1), the node A is initialized to the initial voltage Vini. Accordingly, by initializing the node A prior to the sampling operation, the reliability of sampling of the threshold voltage Vth of the driving transistor DT can be improved.

In the sampling period Ps, the nth scan signal SCAN(N) is applied at an ON level, and the (n−1)th scan signal SCAN(n−1) and the nth emission signal EM(n) are applied at an OFF level. In the sampling period Ps, as the first, third, and sixth transistors T1, T3, and T6 turn on in response to the nth scan signal SCAN(n), the driving transistor DT is diode-connected (that is, the gate electrode and the drain electrode are shorted so that the driving transistor DT acts as a diode), and the data voltage Vdata(n) is applied to the node D. Accordingly, in the sampling period Ps, a current Ids flows between the source electrode and drain electrode of the driving transistor DT, and this current Ids causes the voltage at the node A to rise from the initial voltage Vini to Vdata(n)−Vth, obtained by subtracting the threshold voltage of the driving transistor DT from the data voltage Vdata(n). The initial voltage Vini is equal to or lower than the low-level driving voltage ELVSS. As the voltage at the node A, which is connected to the gate electrode of the driving transistor DT, is adjusted according to the threshold voltage Vth of the driving transistor DT, a driving current may be generated in a subsequent emission period Pe, irrespective of the threshold voltage Vth of the driving transistor DT. Also, by initializing the node C prior to the sampling operation, unnecessary light emission by the organic light emitting diode OLED can be prevented.

The emission period Pe corresponds to the remaining portion of one frame, excluding the initial period Pi and the sampling period Ps. In the emission period Pe, the nth emission signal EM(n) is applied at an ON level, and the (n−1)th scan signal SCAN(n−1) and the nth scan signal SCAN(n) are applied at an OFF level. In the emission period Pe, as the second transistor T2 is turned on in response to the nth emission signal EM(n), the high-level driving voltage ELVDD is connected to the source electrode of the driving transistor DT. Also, as the fourth transistor T4 is turned on in response to the nth emission signal EM(n), the voltage across the nodes B and C becomes substantially equal to the operating voltage Voled of the organic light emitting diode OLED.

The fourth transistor T4 is connected to the anode of the organic light emitting diode OLED and is turned off during the initial period Pi and the sampling period Ps, but not during the emission period Pe, thus preventing a leakage current flowing through the organic light emitting diode OLED at times other than the emission period Pe.

The relational expression for the driving current Ioled flowing through the organic light emitting diode OLED during the emission period Pe is represented by the above Equation 2 explained with reference to FIG. 9C. Accordingly, the organic light emitting diode OLED emits light by a driving current, thereby displaying a desired gray level. Referring to Equation 2, the mathematical expression for the driving current Ioled is $k/2(Vsg-Vth)^2$. The source-gate voltage Vsg, which is programmed in the emission period Pe, is already adjusted according to the threshold voltage Vth of the driving transistor DT. Thus, the threshold voltage Vth of the driving transistor DT does not affect the driving current Ioled, according to the relational expression, as shown in Equation 2. This minimizes the effect of a change in threshold voltage Vth on the driving current Ioled.

Figure 13:
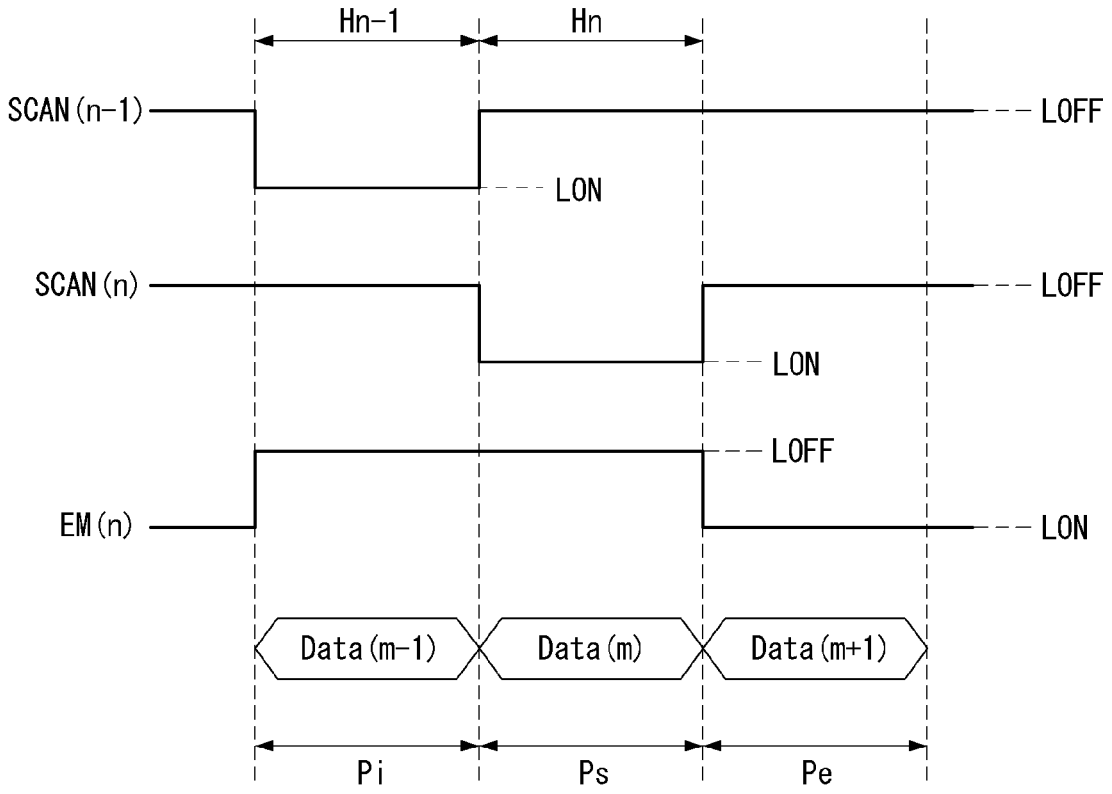
FIG. 13 is a waveform diagram showing data signals and gate signals which are applied to the pixel of FIG. 12.
Figure 14A:
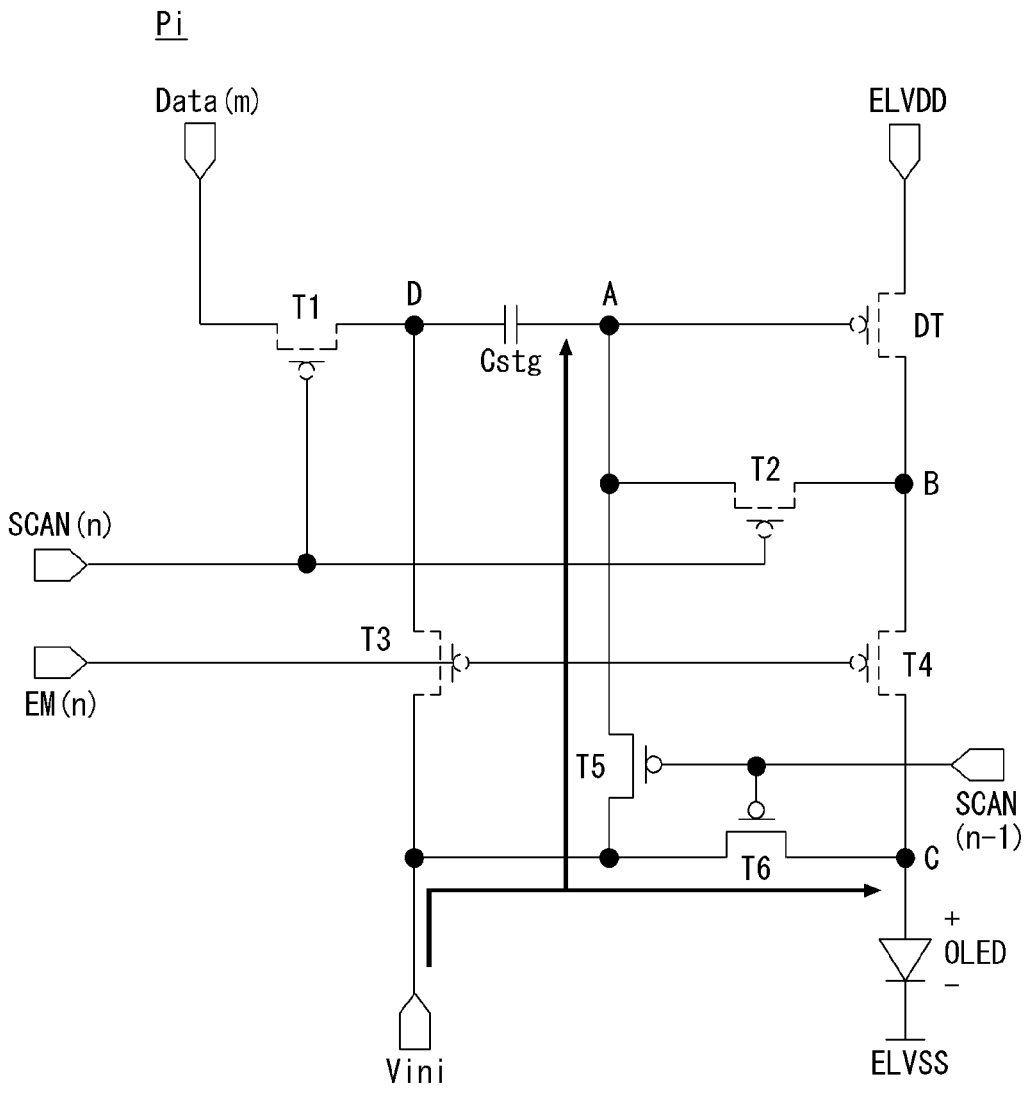
FIGS. 14A, 14B, and 14C are equivalent circuit diagrams of the pixel corresponding to the initial period, sampling period, and emission period of FIG. 12.
Figure 14B:
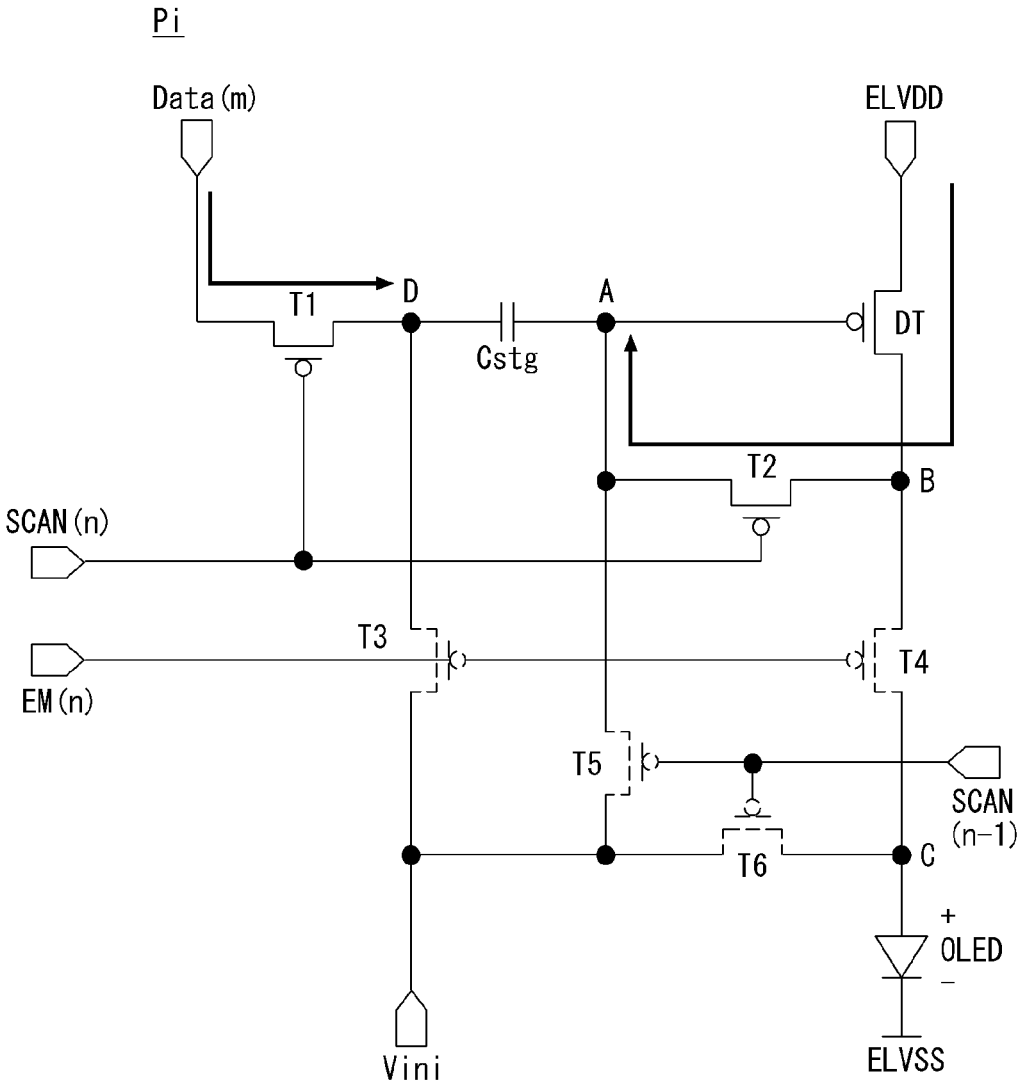
Figure 14C:
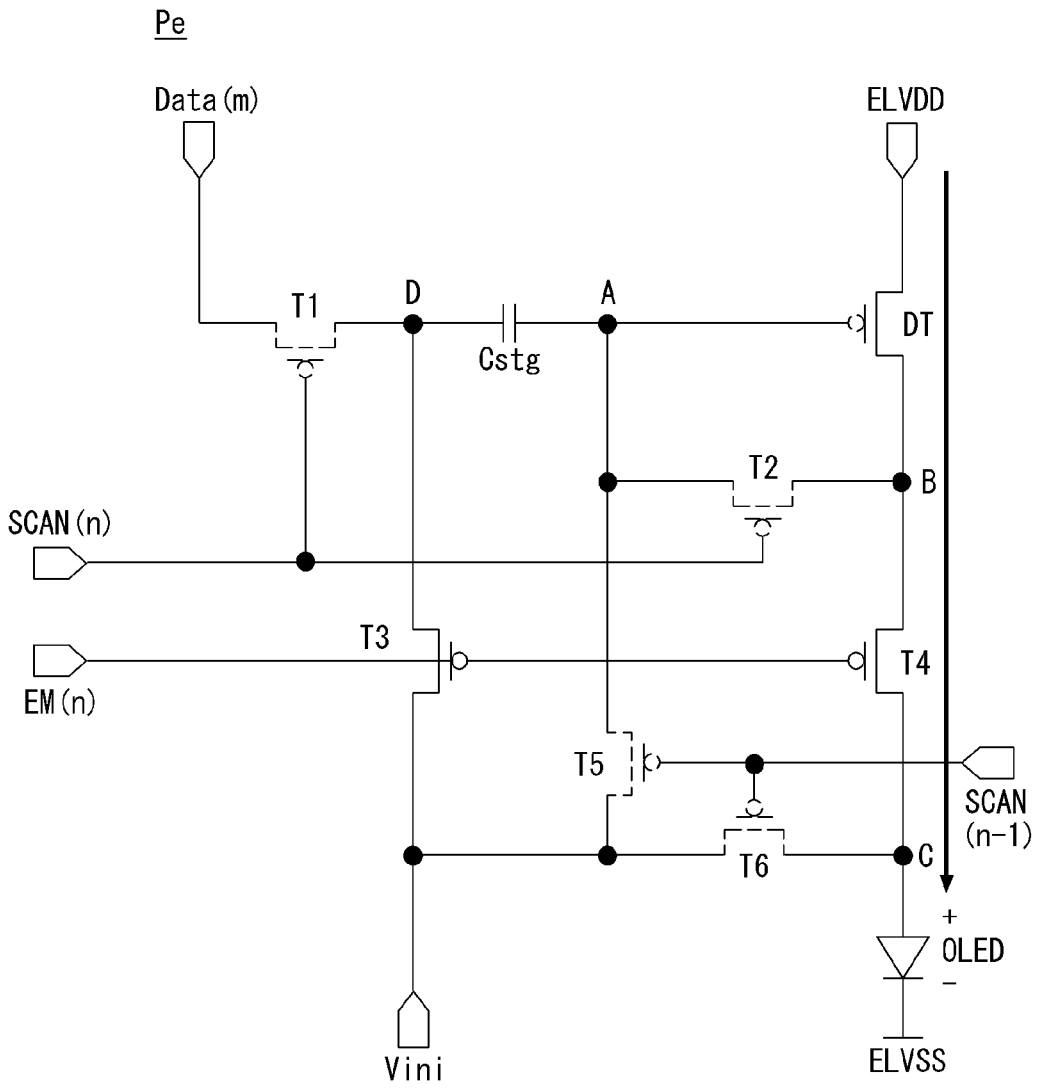

FIG. 12 is an equivalent circuit diagram showing a modification of the pixel structure of FIG. 3. FIG. 13 is a waveform diagram showing data signals and gate signals which are applied to the pixel of FIG. 12. FIGS. 14A, 14B, and 14C are equivalent circuit diagrams of the pixel corresponding to the initial period, sampling period, and emission period of FIG. 12.

Referring to FIG. 12, each pixel PXL arranged in an nth row (n is a natural number) comprises an organic light emitting diode OLED, a driving transistor DT, a first transistor T1, a second transistor T2, a third transistor T3, a fourth transistor T4, a fifth transistor T5, a sixth transistor T6, and a capacitor Cstg.

The organic light emitting diode OLED emits light by a driving current supplied from the driving transistor DT. The organic light emitting diode OLED comprises multiple layers of organic compounds between an anode and a cathode. The anode of the organic light emitting diode OLED is connected to a node C, and the cathode of the organic light emitting diode OLED is connected to an input terminal of the low-level driving voltage ELVSS.

The driving transistor DT controls the driving current applied to the organic light emitting diode OLED based on its source-gate voltage Vsg. The gate electrode of the driving transistor DT is connected to a node A, its source electrode is connected to an input terminal of the high-level driving voltage ELVDD, and its drain electrode is connected to a node B.

The first transistor T1 is connected between a data line 14 and the node D, and is turned on/off in response to an nth scan signal SCAN(n). The gate electrode of the first transistor T1 is connected to an nth scan line to which the nth scan signal SCAN(n) is applied, the source electrode of the first transistor T1 is connected to the data line 14, and the drain electrode of the first transistor T1 is connected to the node D.

The second transistor T2 is connected to the node A and the node B, and is turned on/off in response to the nth scan signal SCAN(n). The gate electrode of the second transistor T2 is connected to the nth scan line to which the nth scan signal SCAN(n) is applied, the source electrode of the second transistor T2 is connected to the node B, and the drain electrode of the second transistor T2 is connected to the node A.

The third transistor T3 is connected between the node D and an input terminal of the initial voltage Vini, and is turned on/off in response to an nth emission signal EM(n). The gate electrode of the third transistor T3 is connected to an nth emission line to which the nth emission signal EM(n) is applied, the source electrode of the third transistor T3 is connected to the node D, and the drain electrode of the third transistor T3 is connected to the input terminal of the initial voltage Vini.

The fourth transistor T4 is connected between the node B and the node C, and is turned on/off in response to the nth emission signal EM(n). The gate electrode of the fourth transistor T4 is connected to the nth emission line to which the nth emission signal EM(n) is applied, the source electrode of the fourth transistor T4 is connected to the node B, and the drain electrode of the fourth transistor T4 is connected to the node C.

The fifth transistor T5 is connected between the node A and an input terminal of the initial voltage Vini, and is turned on/off in response to an (n−1)th scan signal SCAN(n−1). The gate electrode of the fifth transistor T5 is connected to the (n−1)th first scan line to which the (n−1)th scan signal SCAN(n−1) is applied, the source electrode of the fifth transistor T5 is connected to the node A, and the drain electrode of the fifth transistor T5 is connected to the input terminal of the initial voltage Vini.

The sixth transistor T6 is connected between the node C and the input terminal of the initial voltage Vini, and is turned on/off in response to the (n−1)th scan signal SCAN (n−1) signal. The gate electrode of the sixth transistor T6 is connected to the (n−1)th first scan line to which the (n−1)th scan signal SCAN(n−1) is applied, the source electrode of the sixth transistor T6 is connected to the node C, and the drain electrode of the sixth transistor T6 is connected to the input terminal of the initial voltage Vini.

The capacitor Cstg is connected to the node A and the node D.

As described above, as the pixel PXL of FIG. 12 comprises a capacitor Cstg between the node A and the node D, the voltage applied to the node A changes with the voltage applied to the node D. Therefore, the driving transistor DT determines the amount of electric current supplied to the organic light emitting diode OLED in response to a change in voltage across the node A. As such, the stability of circuit operation can be improved, and the luminance of the organic light emitting diode OLED can be easily controlled.

Moreover, using the pixel PXL of FIG. 12, a shorting of the data voltage Vdata and the initial voltage Vini during the initial period can be avoided, and the sampling period for pixel compensation is increased, leading to an improvement in compensation capability.

The operation of the pixel of FIG. 12 will be described with reference to FIGS. 13 to 14C.

One frame may be divided into an initial period Pi in which the node A and the node C are initialized, a sampling period Ps in which the data voltage Vdata(n) is stored and the driving transistor DT operates until the source-gate voltage of the driving transistor DT becomes substantially equal to the threshold voltage, and an emission period Pe in which the organic light emitting diode OLED emits light by the driving current of the driving transistor DT that is driven in response to a voltage change at the node A. In FIG. 13, since an initial operation is performed during an (n−1)th horizontal period Hn−1, an nth horizontal period Hn may be entirely spent on a sampling operation. This ensures a sufficient sampling period Ps, thus making it possible to sample the threshold voltage of the driving transistor more accurately.

In FIG. 14A, the transistors that operate during the initial period Pi are indicated by the solid lines, and the transistors that do not operate during this period are indicated by the dotted lines. Referring to FIGS. 13 and 14A, in the initial period Pi, the (n−1)th scan signal SCAN(n−1) is applied at an ON level, and the nth scan signal SCAN(n) and the nth emission signal EM(n) are applied at an OFF level. In the initial period Pi, as the fifth and sixth transistors T5 and T6 turn on in response to the (n−1)th scan signal SCAN(n−1), the node A and the node C are initialized to the initial voltage Vini.

In the initial period Pi, as the fifth and sixth transistors T5 and T6 turn on in response to the (n−1)th scan signal SCAN(n−1), the node A and the node C are initialized to the initial voltage Vini. By thus initializing the node A and the node C prior to the sampling operation, the sampling reliability can be improved, and unnecessary light emission by the organic light emitting diode OLED can be avoided. To this end, the initial voltage Vini may be chosen from a range of voltages lower than operating voltage of the organic light emitting diode OLED, and the initial voltage Vini may be set equal to or lower than the low-level driving voltage ELVSS.

In FIG. 14B, the transistors that operate during the sampling period Ps are indicated by the solid lines, and the transistors that do not operate during this period are indicated by the dotted lines. Referring to FIGS. 13 and 14B, in the sampling period Ps, the nth scan signal SCAN(N) is applied at an ON level, and the (n−1)th scan signal SCAN (n−1) and the nth emission signal EM(n) are applied at an OFF level. In the sampling period Ps, as the first and second transistors T1 and T2 turn on in response to the nth scan signal SCAN(n), the driving transistor DT is diode-connected (that is, the gate electrode and the drain electrode are shorted so that the driving transistor DT acts as a diode), the data voltage Vdata(n) is applied to the node D, and the high-level driving voltage ELVDD is applied to the node A. In this case, different voltages may be applied to the node D and the node A since the capacitor Cstg is placed between the node D and the node A.

Accordingly, in the sampling period Ps, the driving transistor DT operates until the source-gate voltage becomes substantially equal to the threshold voltage, and the high-level driving voltage ELVDD is applied to the node D while the driving transistor DT operates.

In FIG. 14C, the transistors that operate during the emission period Pe are indicated by the solid lines, and the transistors that do not operate during this period are indicated by the dotted lines. Referring to FIGS. 13 and 14C, in the emission period Pe, the nth emission signal EM(n) is applied at an ON level, and the (n−1)th scan signal SCAN (n−1) and the nth scan signal SCAN(n) are applied at an OFF level. In the emission period Pe, as the third transistor T3 is turned on in response to the nth emission signal EM(n), the initial voltage Vini is applied to the node D. The voltage across the capacitor Cstg corresponding to the change in potential Vdata−Vini across the node D is applied to the node A. In other words, the source-gate voltage Vsg of the driving transistor DT is programmed with the change in potential across the node D being applied to the node A. Accordingly, the driving transistor DT determines the amount of current supplied to the organic light emitting diode OLED in response to a change in voltage across the node A.

Also, as the fourth transistor T4 is turned on in response to the nth emission signal EM(n), the voltage across the node C becomes substantially equal to the operating voltage Voled of the organic light emitting diode OLED.

The relational expression for the driving current Ioled flowing through the organic light emitting diode OLED during the emission period Pe is represented by the following Equation 3. The organic light emitting diode OLED emits light by a driving current, thereby displaying a desired gray level.

The fourth transistor T4 is connected to the anode of the organic light emitting diode OLED and is turned off during the initial period Pi and the sampling period Ps, but not during the emission period Pe, thus preventing a leakage current flowing through the organic light emitting diode OLED at other times than the emission period Pe.

$$I_{oled}=k/2(Vsg-Vth)^2=k/2((Vs-Vg)-Vth)^2=k/2(VDD-(VDD-(Vdata-Vini)-Vth)-Vth)^2=k/2(Vdata-Vini)^2 \quad \text{[Equation 3]}$$

where k/2 indicates a proportional constant determined by the electron mobility, parasitic capacitance, and channel capacity of the driving transistor DT.

The mathematical expression for the driving current Ioled is $k/2(Vsg-Vth)^2$. Vsg, which is programmed in the emission period Pe, is already adjusted according to the threshold voltage Vth of the driving transistor DT. Thus, the threshold voltage Vth of the driving transistor DT does not affect the driving current Ioled, according to the relational expression, as shown in Equation 3. This minimizes the effect of a change in threshold voltage Vth on the driving current Ioled.

Figure 15:
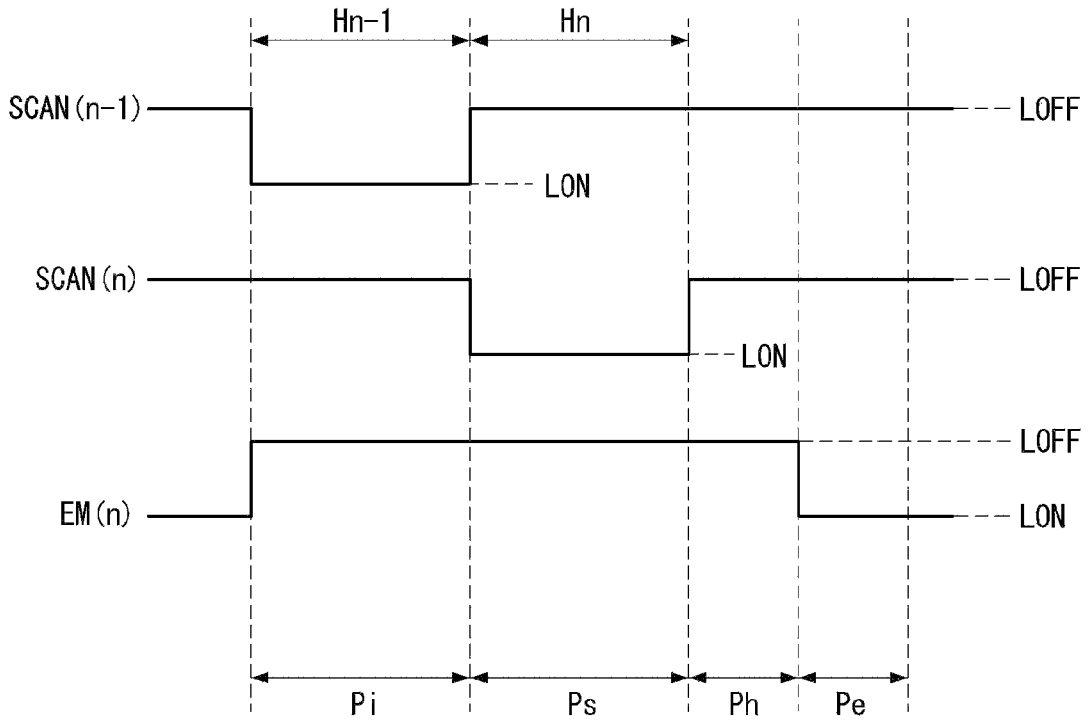
FIG. 15 is a waveform diagram showing data signals and gate signals which are applied to the pixel of FIG. 12.

Although the above description has been given of a frame that is divided into an initial period Pi, a sampling period Ps, and an emission period Pe, the present disclosure is not limited thereto, and as shown in FIG. 15, a frame may further comprises a hold period Ph between the initial period Pi and the emission period Pe.

In the hold period Ph, the nth scan signal SCAN(n) is applied at an OFF level, and the (n−1)th scan signal SCAN (n−1) and the nth emission signal EM(n) are applied at an OFF level.

In this way, in the hold period Ph, the nth emission signal EM(n) is not applied at an ON level but is held at an OFF level for a certain amount of time while the nth scan signal SCAN(n) is applied at an ON level. Accordingly, it is possible to prevent noise caused by a current change or voltage change, which may occur when the nth scan signal SCAN(n) and the nth emission signal EM(n) are synchronized. The other elements shown in FIG. 15 are substantially identical to those explained in FIG. 8.

Conventionally, each pixel is driven with an nth first scan signal SCAN1(*n*), an nth second scan signal SCAN2(*n*), and nth emission signal EM(n). Thus, three GIP blocks are used per pixel. On the contrary, the pixel structure of this specification explained with respect to FIGS. 2 through 15 is driven with the (n−1)th scan signal SCAN(n−1), nth scan signal SCAN(n), and nth emission signal EM(n). Accordingly, the pixel structure of this specification can be driven using a GIP consisting of two blocks. This can reduce the width of a GIP forming area, thereby achieving a narrow bezel.

Figure 16:
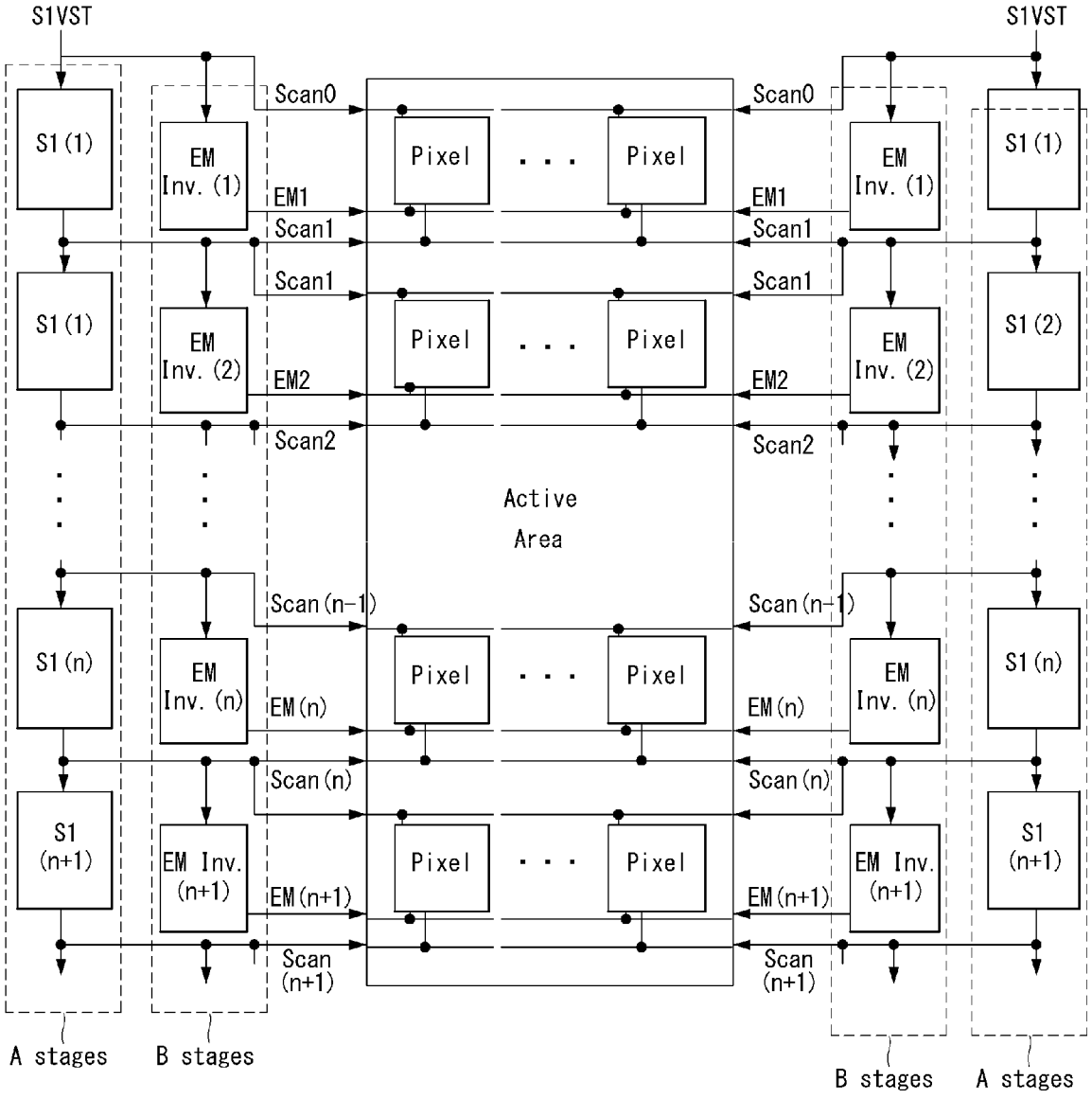
FIGS. 16 to 18 are views showing various examples of implementing a scan driver's shift registers and inverters of an emission driver in a gate drive circuit.
Figure 17:
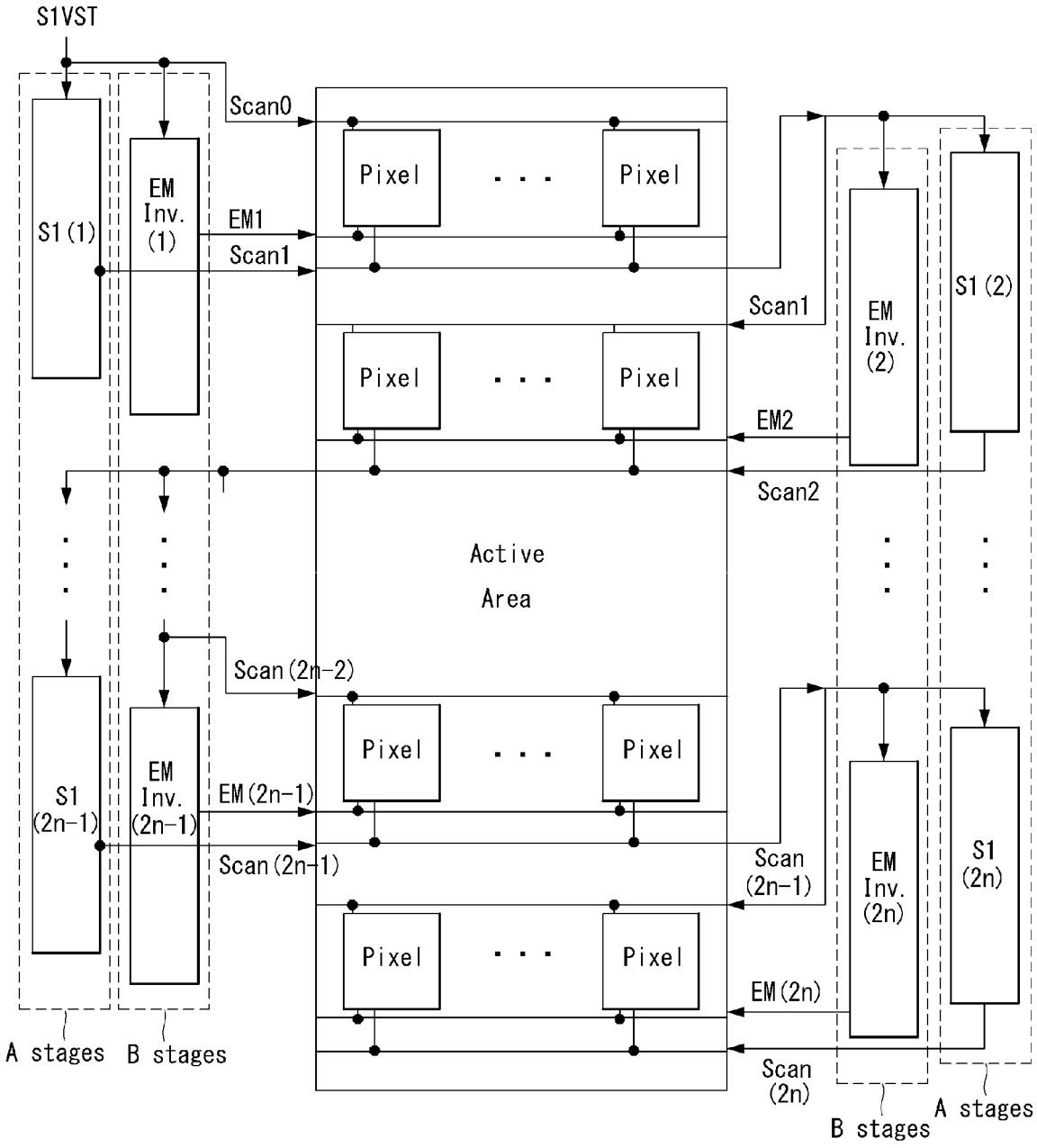
Figure 18:
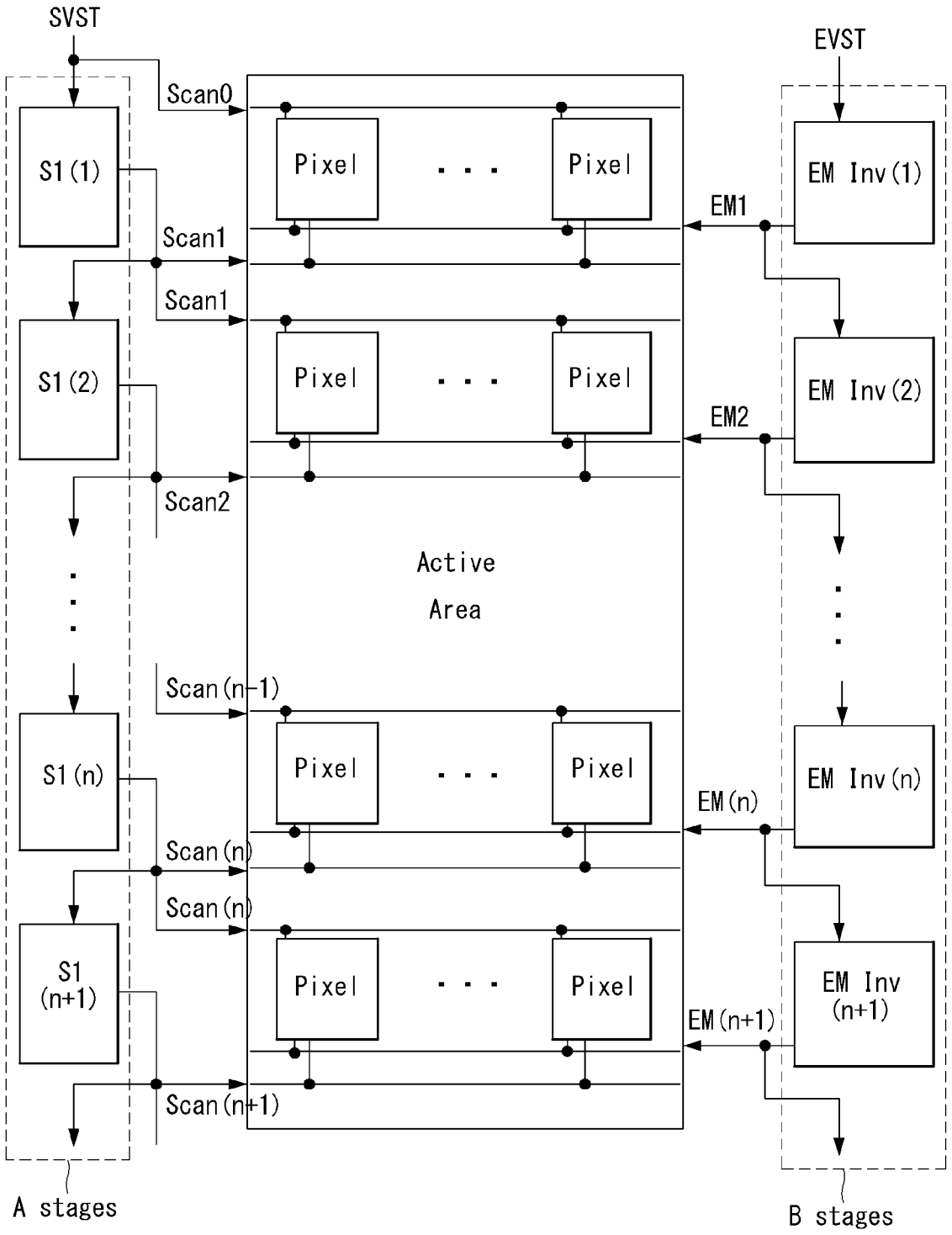

FIGS. 16 to 18 are views showing various examples of implementing a scan driver's shift registers and inverters of an emission driver in a gate drive circuit.

FIG. 16 is a view illustrating the gate drive circuit 13 of FIG. 2 in detail. Referring to FIG. 16, the gate drive circuit may comprise a scan driver S1(*n*) and an emission driver EM Inv.(n).

The scan driver may generate a scan signal and provide it to the scan lines on a line-sequential basis, in order to drive at least one scan line connected to each pixel row. The scan driver comprises shift registers. Each shift register comprises A stages S1(1) to S1(*n*+1) connected in cascade. The emission driver may generate an emission signal and provide it to the emission lines, in order to drive at least one emission line connected to each pixel row. The emission driver comprises inverters. Each inverter comprises B stages EM Inv.(1) to EM Inv.(n+1) connected in cascade.

The A stages S1(1) to S1(*n*+1) and the B stages EM Inv.(1) to EM Inv.(n+1) may be disposed on both sides of an active area where an image is displayed, and be symmetrically disposed with respect to the active area.

The A stages S1(*n*−1) simultaneously output an (n−1)th scan signal SCAN(n−1) in response to a start pulse S1VST. Apart from the (n−1)th scan signal SCAN(n−1), the A stages S1(*n*−1) may output a carry signal and supply it as a start pulse S1VST simultaneously to the next A stages S1(*n*). The carry signal may be input as a start pulse for the next stage.

As the (n−1)th scan signal SCAN(n−1) is supplied simultaneously to an (n−1)th scan line of (n−1)th pixels and an (n−1)th scan line of an nth pixels, the (n−1)th scan signal SCAN(n−1) is supplied to the B stages EM Inv.(n) and the A stages S1(*n*).

Upon receiving the (n−1)th scan signal SCAN(n−1), the B stages EM Inv.(n) simultaneously supply an nth emission signal EM(n), which is synchronized with the (n−1)th scan signal SCAN(n−1) and is inverted from the (n−1)th scan signal SCAN(n−1), to an emission line of the nth pixel.

Upon receiving the (n−1)th scan signal SCAN(n−1) or upon receiving the (n−1)th scan signal SCAN(n−1) and a carry signal, the A stages S1(*n*) simultaneously supply an nth scan signal SCAN(n) to an nth scan line of the nth pixel in response to scan timing control signals such as a start signal Vst and a clock GCLK.

As the nth scan signal SCAN(n) is supplied simultaneously to the nth scan line of the nth pixel and an nth scan line of an (n+1)th pixel, the nth scan signal SCAN(n) is supplied to the B stages EM Inv.(n+1) and the A stages S1(*n*+1).

Upon receiving the nth scan signal SCAN(n), the B stages EM Inv.(n+1) simultaneously supply an (n+1)th emission signal EM(n+1), which is synchronized with the nth scan signal SCAN(n) and is inverted from the nth scan signal SCAN(n), to an emission line of an (n+1)th pixel.

Upon receiving the nth scan signal SCAN(n) or upon receiving the nth scan signal SCAN(n) and a carry signal, the A stages S1(*n*+1) simultaneously supply an (n+1)th scan signal SCAN(n+1) to an (n+1)th scan line of the (n+1)th pixel in response to scan timing control signals such as a start signal Vst and a clock GCLK.

Generally, the gate drive circuit includes a first scan driver, a second scan driver, and an emission driver, in order to drive the pixels. Also, the gate drive circuit requires at least three blocks of A to C stages to drive the pixels. In contrast, in this exemplary embodiment, the pixels may be driven with the scan driver and the emission driver without an additional driver. Thus, in this exemplary embodiment, the pixels may be driven with the A stages and the B stages without additional stages. Accordingly, a narrow bezel can be achieved according to this exemplary embodiment.

Referring to FIG. 17, odd numbered A stages S1(1) to S1(2*n*−1) among A stages S1(1) to S1(2*n*) and odd numbered B stages EM Inv.(1) to EM Inv.(2*n*−1) among B stages EM Inv.(1) to EM Inv.(2*n*) may be disposed on one portion of the active area, and even-numbered A stages S1(2) to S1(2*n*) among A stages S1(1) to S1(2*n*) and even numbered B stages EM Inv.(2) to EM Inv.(2*n*) among B stages EM Inv.(1) to EM Inv.(2*n*) may be disposed on the other portion of the active area, Accordingly, the first set of A stages S1(1) to S1(2*n*−1) and B stages EM Inv.(1) to EM Inv.(2*n*−1) disposed on one portion of the active area operate first, and then the second set of A stages S1(2) to S1(2*n*) and B stages EM Inv.(2) to EM Inv.(2*n*) disposed on the other portion of the active area operate. In other words, the A stages S1(1) to S1(2*n*) and the B stages EM Inv.(1) to EM Inv.(2*n*) may operate sequentially in a zigzag manner.

The A stage S1(2*n*−1) disposed on one portion of the active area outputs a (2*n*−1)th scan signal SCAN(2*n*−1) in response to a start pulse S1VST, and the B stage EM Inv.(2*n*−1) outputs a (2*n*−1)th emission signal EM(2*n*−1) in response to the start pulse S1VST. The scan signal SCAN (2*n*−1) output from the A stage S1(2*n*−1) is applied to the A stage S1(2*n*) and B stage EM Inv.(2*n*) disposed on the other portion of the active area, the A stage S1(2*n*) and B stage EM Inv.(2*n*) output a scan signal SCAN(2*n*) and an emission signal EM(2*n*), respectively, in response to the scan signal SCAN(2*n*−1), and the output scan signal SCAN(2*n*) is applied to the A stage S1(2*n*+1) and B stage EM Inv.(2*n*+1) disposed on one portion of the active area.

As described above, this exemplary embodiment can improve the degree of freedom of space utilization and achieve a narrow bezel by disposing the odd-numbered A and B stages and the even-numbered A and B stages, separately.

Referring to FIG. 18, the A stages S1(1) to S1(*n*+1) may be disposed on one portion of the active area, and the B stages EM Inv.(1) to EM Inv.(n+1) may be disposed on the other portion of the active area.

Accordingly, the B stages EM Inv.(1) to EM Inv.(n+1) disposed on the other portion of the active area correspond to the A stages S1(1) to S1(*n*+1) disposed on one portion of the active area. The A stages S1(1) to S1(*n*+1) disposed on one portion of the active area and the B stages EM Inv.(1) to EM Inv.(n+1) disposed on the other portion of the active area may operate sequentially.

The A stages S1(1) to S1(*n*+1) and B stages EM Inv.(1) to EM Inv.(n+1) disposed on one and the other portions of the active area respectively may apply signals to the pixels in response to different start signals SVST and EVST.

The A stage S1(*n*) may apply a scan signal SCAN(n) to the nth pixel and the (n+1)th pixel simultaneously in response to a start signal SVST, and may apply a scan signal SCAN(n) to the A stage S1(*n*+1). At the same time, the B stage EM Inv.(n) may apply an emission signal EM(n) to the nth pixel in response to a start signal EVST, and may apply a signal to the B stage EM Inv.(n+1). In this way, the A stages and the B stages may operate simultaneously and sequentially.

As described above, this exemplary embodiment can improve the degree of freedom of space utilization and achieve a narrow bezel by disposing the A stages S1(1) to S1(*n*+1) and the B stages EM Inv.(1) to EM Inv.(n+1), separately.

Figure 19:
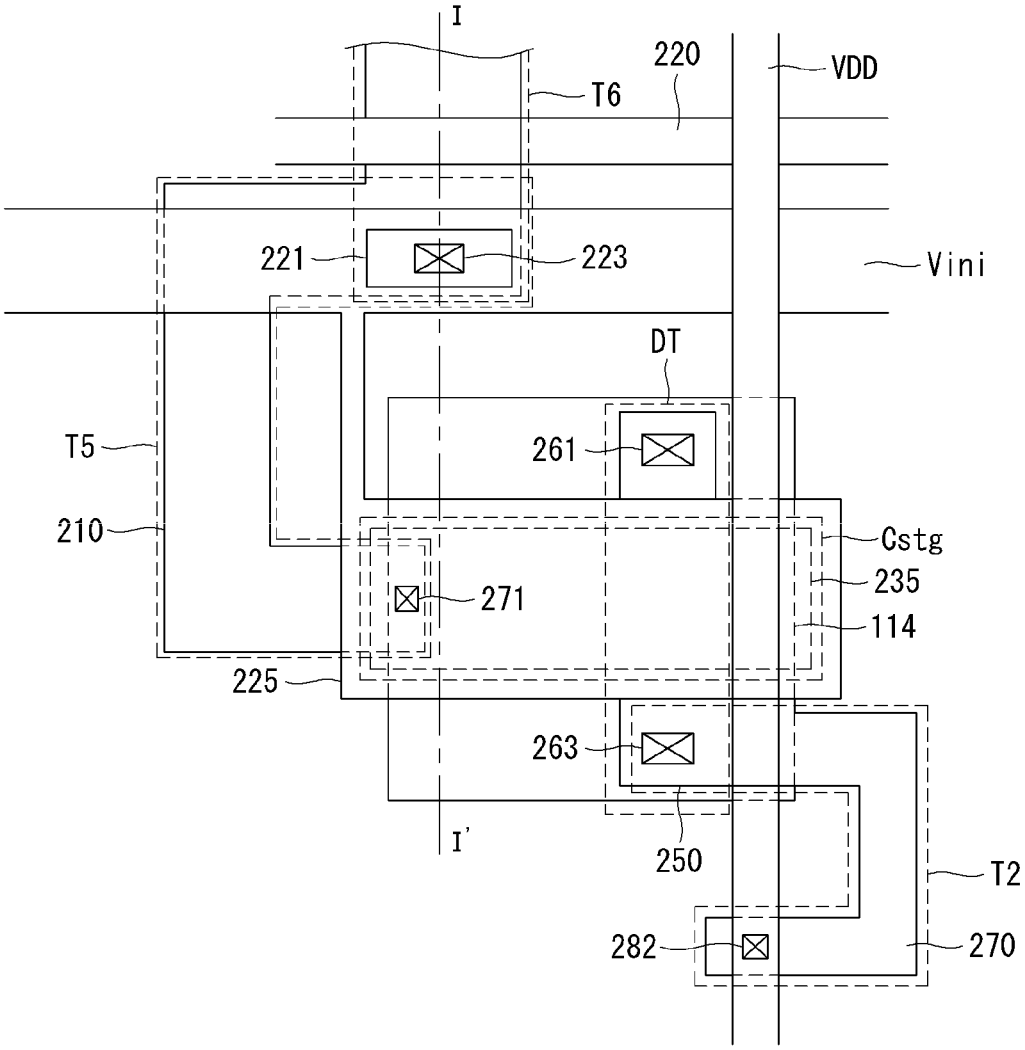
FIG. 19 is a view showing an array of a region for forming a capacitor in a pixel according to an exemplary embodiment of the present disclosure.

FIG. 19 is a view showing the array configuration of nodes connected to two electrodes of the capacitor Cstg in the pixel of FIG. 7.

Referring to FIG. 19, the fifth transistor T5 comprises a semiconductor layer 210, a gate electrode 220, a drain electrode 221, and a source electrode, the sixth transistor T6 comprises a semiconductor layer 210, a gate electrode 220, a drain electrode 221, and a source electrode, and the capacitor Cstg comprises a first electrode 225 and a second electrode. The first electrode 225 of the capacitor Cstg is connected to an initial voltage line Vini, which is for receiving signals from the input terminal of the initial voltage Vini, and the drain electrodes 221 of the fifth and sixth transistors T6, and the second electrode corresponds to the gate electrode 235 of the driving transistor DT. Accordingly, a capacitance may be formed at an overlap portion between the first and second electrodes 225 and 235. The source electrode of the fifth transistor T5 may be connected to the gate electrode 235 of the driving transistor DT through a contact hole 271, and the source electrode of the sixth transistor T6 may be connected to the anode of the organic light emitting diode. The semiconductor layer 250 of the driving transistor DT may be formed below the gate electrode 235, and a source contact hole 261 and a drain contact hole 263 may be connected to a source electrode and a drain electrode, each of a respective transistor.

The first electrode 225 of the capacitor Cstg may be larger in size than the gate electrode 235 of the driving transistor DT. In this way, the initial voltage Vini is applied to the first electrode 225, thus suppressing the effect of a mobile charge in the substrate 110. This can improve the reduction in the driving current of the driving transistor DT caused by the mobile charge. The initial voltage Vini may be a negative voltage.

Moreover, the first electrode 225 of the capacitor Cstg is connected to the gate electrode 235 of the driving transistor DT and disposed in an area corresponding to a semiconductor layer of the third transistor T3 that operates in the sampling period, thereby decreasing the effect of the mobile charge on the semiconductor layer of the third transistor T3. In other exemplary embodiments as well, the first electrode 225 of the capacitor Cstg may be disposed in the same way as in FIG. 7.

Alternatively, a metal layer 114 may be positioned under the semiconductor layer 250 of the driving transistor DT to suppress the effect of the mobile charge on the semiconductor layer 250 of the driving transistor DT. The metal layer 114 may be the same size as or larger than the semiconductor layer 250 of the driving transistor DT.

The metal layer 114 may be formed of a semiconductor, such as silicon (Si), or a conductive metal; for example, at least one among molybdenum (Mo), aluminum (Al), chrome (Cr), gold (Au), titanium (Ti), nickel (Ni), neodymium (Nd), copper (Cu), and an alloy of two or more thereof.

Also, the first electrode of the capacitor Cstg is not connected to a high-level voltage line VDD that receives signals from the high-level driving voltage input terminal ELVDD, but is connected to the initial voltage line Vini, thereby reducing the number of contact holes.

Figure 21:
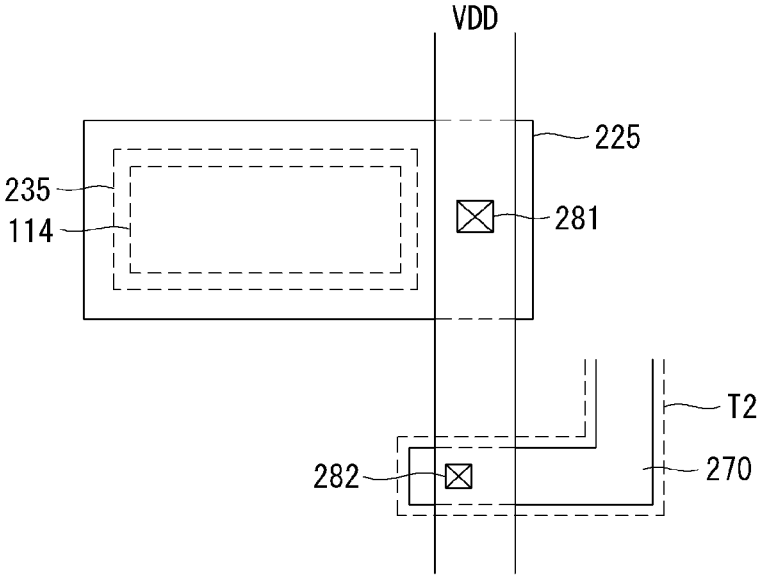
FIG. 21 is a view showing an array of a region for forming a capacitor according to a comparative example.

FIG. 21 shows a comparative example in which one electrode of the capacitor Cstg of FIG. 7 is not connected to the initial voltage line Vini but is connected to the high-level voltage line VDD.

Referring to FIG. 21, the second transistor T2 is connected to the high-level voltage line VDD via a contact hole 282, and the first electrode 225 of the capacitor Cstg is connected to the high-level voltage line VDD via another contact hole 281. In other words, the contact hole 281 is added to connect the capacitor Cstg and the high-level voltage line VDD. By the way, in a case where one electrode of the capacitor Cstg is connected to the initial voltage line Vini, as shown in FIGS. 7 and 19, the first electrode 225 of the capacitor Cstg is connected to the drain electrodes of the fifth and sixth transistors T5 and T6 and the initial voltage line Vini via a single contact hole, thereby reducing the number of contact holes compared to the comparative example of FIG. 21. By connecting one electrode of the capacitor Cstg to the initial voltage line Vini, rather than to the high-level voltage line VDD, the number of contact holes can be reduced, resulting in sufficient pixel design margin.

A cross-sectional view taken along line I-I' of FIG. 19 will be explained below with reference to FIG. 20.

Figure 20:
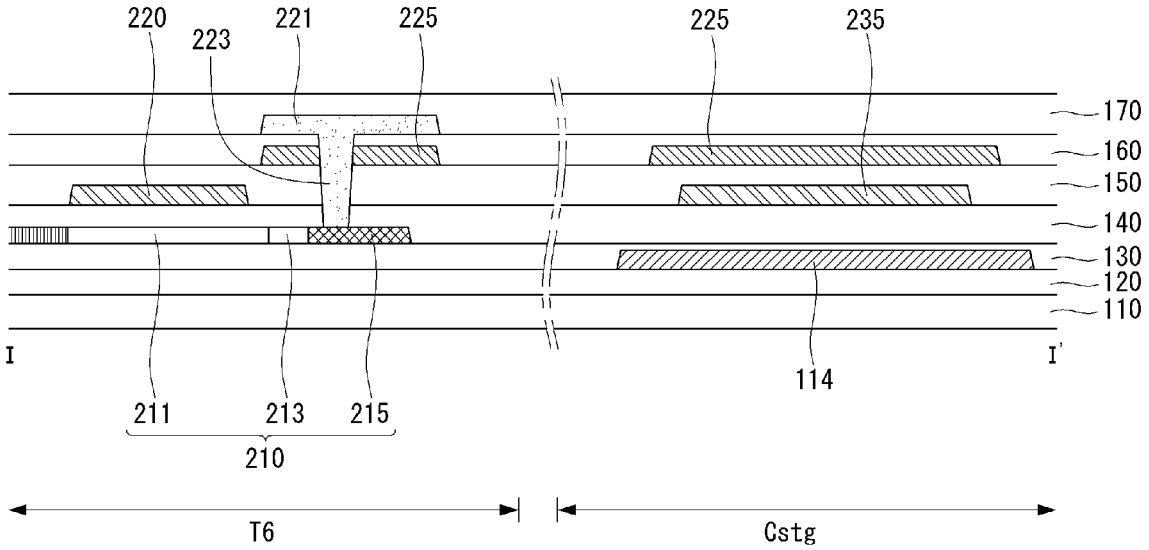
FIG. 20 is a cross-sectional view taken alone line I-I' of FIG. 19.

Referring to FIG. 20, a first buffer layer 120 is positioned on the substrate 110. The first buffer layer 120 may be formed of one among silicon oxide (SiOx), silicon nitride (SiNx), and a multi-layer thereof.

The substrate 110 may be a glass, metal, plastic, or polyimide insulating layer, and may be composed of two or more layers. A flexible organic light emitting display may be made of a flexible material such as plastic. Also, when organic light emitting diodes that allow for easy fabrication of flexible displays are used in vehicle lighting or vehicle displays, the vehicle lighting or vehicle displays may have various designs and offer design freedom depending on their structure or appearance.

The metal layer 114 is positioned on the first buffer layer 120. A second buffer layer 130 is positioned on the metal layer 114. The second buffer layer 130 may be formed of one among silicon oxide (SiOx), silicon nitride (SiNx), or a multi-layer thereof.

The semiconductor layer 210 is positioned on the second buffer layer 130. The semiconductor layer 210 may consist of silicon semiconductor or oxide semiconductor. The semiconductor layer 210 of the sixth transistor T6 comprises a drain region 215, a source region, lightly-doped regions 213, and a channel region 211 positioned between the lightly-doped regions 213. The semiconductor layer 210 may be doped with at least one p-type impurity such as boron (B), aluminum (Al), gallium (Ga), or indium (In). The semiconductor layers of the driving transistor DT and fifth transistor T5 may be formed by the same process as the semiconductor layer 210 of the sixth transistor T6.

A first insulating layer 140 is positioned on the semiconductor layer 210. The first insulating layer 140 may be formed of one among silicon oxide (SiOx), silicon nitride (SiNx), or a multi-layer thereof.

A gate electrode 220 of the sixth transistor T6 is positioned above the channel region 211 of the semiconductor layer 210. The gate electrode 220 may be formed of any one among molybdenum (Mo), aluminum (Al), chrome (Cr), gold (Au), titanium (Ti), nickel (Ni), neodymium (Nd), copper (Cu), and an alloy of two or more thereof. The gate electrodes 235 of the driving transistor DT and fifth transistor T5 may be formed by the same process as the gate electrode 220 of the sixth transistor T6.

A second insulating layer 150 is positioned on the gate electrodes 220 and 235. The second insulating layer 150 may be formed of one among silicon oxide (SiOx), silicon nitride (SiNx), or a multi-layer thereof.

The first electrode 225 of the capacitor Cst connected to the initial voltage line Vini is positioned on the second insulating layer 150.

That is, the first electrode 225 connected to the initial voltage line Vini and the second electrode 235 connected to the gate electrode 235 of the driving transistor DT are disposed to overlap, forming the capacitor Cstg. Also, the first electrode 225 is larger in size than the second electrode 235, thus decreasing the effect of a mobile charge on the semiconductor layer of the driving transistor DT.

A third insulating layer 160 is positioned on the first electrode 225 of the capacitor Cstg. The third insulating layer 160 may be formed of one among silicon oxide (SiOx), silicon nitride (SiNx), or a multi-layer thereof.

After forming the third insulating layer 160, the first to third insulating layers 140, 150, and 160 and the first electrode 225 of the capacitor Cstg are selectively etched to form a contact hole 223. Part of the semiconductor layer 210 of the sixth transistor T6 is exposed through the contact hole 223.

The drain electrode 221 of the sixth transistor T6 formed in the contact hole 223 is positioned on the third insulating layer 160. The drain electrode 221 of the sixth transistor T6 shares the same contact hole 223 with the drain electrode of the fifth transistor T5, and is connected to the initial voltage line Vini and the first electrode 225 of the capacitor Cstg. The drain electrode 221 may be made of any one among molybdenum (Mo), aluminum (Al), chrome (Cr), gold (Au), titanium (Ti), nickel (Ni), neodymium (Nd), copper (Cu), and an alloy of two or more thereof. The drain electrode 221 may be a two-layer structure of molybdenum/aluminum-neodymium or a three-layer structure of titanium/aluminum/titanium, molybdenum/aluminum/molybdenum, or molybdenum/aluminum-neodyminum/molybdenum.

A fourth insulating layer 170 is positioned on the drain electrode 221. The fourth insulating layer 170 may be a planarizing layer for alleviating the unevenness of the underlying structure, and may be formed of an organic material such as polyimide, benzocyclobutene series resin, or acrylate.

The source and drain electrodes of the aforementioned transistors may be used interchangeably—especially, in case of the first to sixth transistors that function to turn on and off, apart from the driving transistor DT.

An organic light emitting display of this specification may be used in applications such as TV, mobile, tablet PCs, monitors, smartwatches, laptop computers, vehicle displays, etc. An organic light emitting display of this specification also may be used in displays of various shapes such as flat displays, bendable displays, foldable displays, and rollable displays.

The exemplary embodiments of this disclosure can block leakage current flowing to the organic light emitting diode at times other than the emission period by connecting an emission transistor to the anode of the organic light emitting diode.

Moreover, the exemplary embodiments of this disclosure can improve the lifetime of the organic light emitting diode because the initial voltage Vini applied during the initial period is lower than the low-level driving voltage ELVSS.

Moreover, the exemplary embodiments of this disclosure can avoid a short between the data voltage Vdata and the initial voltage Vini during the initial period and improve compensation capability because of the longer sampling period for pixel compensation.

Moreover, the exemplary embodiments of this disclosure can improve the accuracy of threshold voltage compensation because a sufficient sampling period for the threshold voltage of the driving transistor is ensured by connecting the gate electrode of the first initial transistor for initializing the driving transistor of an nth pixel to an (n−1)th scan line to which an (n−1)th scan signal SCAN(n−1) is applied in an (n−1)th pixel.

Moreover, the exemplary embodiments of this disclosure can reduce the number of contact holes and ensure pixel design margin by connecting one electrode of the capacitor to the initial voltage input terminal, rather than the high-level driving voltage.

Furthermore, the exemplary embodiments of this disclosure can reduce the effect of a mobile charge on the semiconductor layer of the driving transistor by placing a metal layer under the semiconductor layer of the driving transistor.

Furthermore, the exemplary embodiments of this disclosure can reduce the effect of a mobile charge on the semiconductor layer of the driving transistor because one electrode of the capacitor has a larger area than the gate electrode of the driving transistor.

Furthermore, the exemplary embodiments of this disclosure can reduce the effect of a mobile charge on the semiconductor layer of transistors by placing one electrode of the capacitor in an area corresponding to the semiconductor layer of the transistors that operate during the sampling period.

Furthermore, the exemplary embodiments of this disclosure can prevent distortion in luminescence intensity caused by leakage current because at least one of the transistors connected to the capacitor comprises at least two series-connected transistors.

Furthermore, the exemplary embodiments of this disclosure can drive the pixels through a gate drive circuit comprising only a scan driver and an emission driver by initializing the driving transistor or the organic light emitting diode during the sampling period of the pixel in the previous row. Accordingly, a narrow bezel can be achieved.

An organic light emitting display according to an exemplary embodiment of this specification may be explained as follows.

An exemplary embodiment of this specification provides an organic light emitting display comprising a display panel having a plurality of pixels, a gate drive circuit that drives scan lines and emission lines on the display panel, and a data drive circuit that drives data lines on the display panel. Each of the pixels is arranged in an nth row (n is a natural number) comprising an organic light emitting diode having an anode connected to a node C and a cathode connected to a low-level driving voltage input terminal, a driving transistor having a gate electrode connected to a node A, a source electrode connected to a node D, and a drain electrode connected to a node B, the driving transistor controlling a driving current applied to the organic light emitting diode, a first transistor that is connected between a data line and the node D, a second transistor that is connected between the node D and a high-level driving voltage input terminal, a third transistor that is connected to the node A and the node B, a fourth transistor that is connected to the node B and the node C, a fifth transistor that is connected between the node A and an initial voltage input terminal, and a capacitor that is connected between the node A and the initial voltage input terminal. Accordingly, a sufficient sampling period may be allowed to sample the threshold voltage of the driving transistor, thus improving the accuracy of compensation of the threshold voltage.

One frame comprises an initial period in which the node A is initialized, a sampling period in which a threshold voltage of the driving transistor is sampled and stored at the node A, an emission period in which a source-gate voltage of the driving transistor is programmed to have the sampled threshold voltage, and the organic light emitting diode emits light by a driving current corresponding to the programmed source-gate voltage. A gate electrode of the fifth transistor is connected to an (n−1)th scan line to which an (n−1)th scan signal is applied, a gate electrode of the first transistor and a gate electrode of the third transistor are connected to an nth scan line to which an nth scan signal is applied, and a gate electrode of the second transistor and a gate electrode of the fourth transistor are connected to an nth emission line to which an nth emission signal is applied. In the initial period, the (n−1)th scan signal is applied at an ON level, and the nth scan signal and the nth emission signal are applied at an OFF level. In the sampling period, the nth scan signal is applied at the ON level, and the (n−1)th scan signal and the nth emission signal are applied at the OFF level. In the emission signal, the nth emission signal is applied at the ON level, and the (n−1)th scan signal and the nth scan signal are applied at the OFF level.

The organic light emitting display further comprises a sixth transistor connected between the initial voltage input terminal and the node C.

One frame comprises an initial period in which the node A and the node C are initialized, a sampling period in which a threshold voltage of the driving transistor is sampled and stored at the node A, an emission period in which a source-gate voltage of the driving transistor is programmed to have the sampled threshold voltage, and the organic light emitting diode emits light by a driving current corresponding to the programmed source-gate voltage. A gate electrode of the fifth transistor and a gate electrode of the sixth transistor are connected to an (n−1)th scan line to which an (n−1)th scan signal SCAN(n−1) is applied, a gate electrode of the first transistor and a gate electrode of the third transistor are connected to an nth scan line to which an nth scan signal is applied, and a gate electrode of the second transistor and a gate electrode of the fourth transistor are connected to an nth emission line to which an nth emission signal is applied. In the initial period, the (n−1)th scan signal is applied at an ON level, and the nth scan signal and the nth emission signal are applied at an OFF level. In the sampling period, the nth scan signal is applied at the ON level, and the (n−1)th scan signal and the nth emission signal are applied at the OFF level. In the emission period, the nth emission signal is applied at the ON level, and the (n−1)th scan signal and the nth scan signal are applied at the OFF level.

One frame comprises an initial period in which the node A and the node C are initialized, a sampling period in which a threshold voltage of the driving transistor is sampled and stored at the node A, an emission period in which a source-gate voltage of the driving transistor is programmed to have the sampled threshold voltage, and the organic light emitting diode emits light by a driving current corresponding to the programmed source-gate voltage. A gate electrode of the fifth transistor is connected to an (n−1)th scan line to which an (n−1)th scan signal SCAN(n−1) is applied, a gate electrode of the first transistor, a gate electrode of the third transistor, and a gate electrode of the sixth transistor are connected to an nth scan line to which an nth scan signal is applied, and a gate electrode of the second transistor and a gate electrode of the fourth transistor are connected to an nth emission line to which an nth emission signal is applied. In the initial period, the (n−1)th scan signal is applied at an ON level, and the nth scan signal and the nth emission signal are applied at an OFF level. In the sampling period, the nth scan signal is applied at the ON level, and the (n−1)th scan signal and the nth emission signal are applied at the OFF level. In the emission period, the nth emission signal is applied at the ON level, and the (n−1)th scan signal and the nth scan signal are applied at the OFF level.

The initial period is included in an (n−1)th horizontal period, and the sampling period is included in an nth horizontal period.

In each pixel, each transistor whose source electrode or drain electrode is connected to one electrode of the capacitor comprises at least two series-connected transistors, which are switched on by a same control signal.

A first electrode of the capacitor is positioned between insulating layers that are disposed between a semiconductor layer and a source electrode of the fifth transistor, and the first electrode of the capacitor is connected via a contact hole to a drain electrode of the fifth transistor and to a drain electrode of the sixth transistor.

The organic light emitting display further comprises a metal layer under a semiconductor layer of the driving transistor.

A first electrode of the capacitor that receives an initial voltage from the initial voltage input terminal is disposed corresponding to the gate electrode of the driving transistor.

A first electrode of the capacitor that receives an initial voltage from the initial voltage input terminal is disposed in an area corresponding to a semiconductor layer of the third transistor that operates during a sampling period.

A first electrode of the capacitor is the gate electrode of the driving transistor connected to the node A, a second electrode of the capacitor corresponds to an electrode connected to the initial voltage input terminal, and the second electrode is not connected to a high-level driving voltage input terminal and is connected to the initial voltage input terminal.

Another exemplary embodiment of this specification provides an organic light emitting display comprising a display panel having a plurality of pixels, a gate drive circuit that drives scan lines and emission lines on the display panel, and a data drive circuit that drives data lines on the display panel. Each of the pixels is arranged in an nth row (n is a natural number) comprising an organic light emitting diode having an anode connected to a node C and a cathode connected to a low-level driving voltage input terminal, a driving transistor having a gate electrode connected to a node A, a source electrode connected to a high-level driving voltage input terminal, and a drain electrode connected to a node B, the driving transistor controlling a driving current applied to the organic light emitting diode, a first transistor that is connected between a data line and a node D, a second transistor that is connected to the node A and the node B, a third transistor that is connected between the node D and an initial voltage input terminal, a fourth transistor that is connected to the node B and the node C, a fifth transistor that is connected between the node A and the initial voltage input terminal, a sixth transistor that is connected between the initial voltage input terminal and the node C, and a capacitor that is connected between the node A and the node D. Therefore, the driving transistor determines the amount of electric current supplied to the organic light emitting diode OLED in response to a change in voltage across the node A. As such, the stability of circuit operation can be improved, and the luminance of the organic light emitting diode OLED can be controlled. Moreover, a short between the data voltage Vdata and the initial voltage Vini during the initial period can be avoided, and the sampling period for pixel compensation is increased, leading to an improvement in compensation capability.

One frame comprises an initial period in which the node A and the node C are initialized, a sampling period in which a threshold voltage of the driving transistor is sampled and stored at the node A, an emission period in which a source-gate voltage of the driving transistor is programmed to have the sampled threshold voltage, and the organic light emitting diode emits light by a driving current corresponding to the programmed source-gate voltage. A gate electrode of the fifth transistor and a gate electrode of the sixth transistor are connected to an (n−1)th scan line to which an (n−1)th scan signal SCAN(n−1) is applied, a gate electrode of the first transistor and a gate electrode of the second transistor are connected to an nth scan line to which an nth scan signal is applied, and a gate electrode of the third transistor and a gate electrode of the fourth transistor are connected to an nth emission line to which an nth emission signal is applied. In the initial period, the (n−1)th scan signal is applied at an ON level, and the nth scan signal and the nth emission signal are applied at an OFF level. In the sampling period, the nth scan signal is applied at the ON level, and the (n−1)th scan signal and the nth emission signal are applied at the OFF level. In the emission period, the nth emission signal is applied at the ON level, and the (n−1)th scan signal and the nth scan signal are applied at the OFF level.

The initial period is included in an (n−1)th horizontal period, and the sampling period is included in an nth horizontal period.

The second transistor comprises at least two series-connected transistors, which are switched on by a same control signal.

Yet another exemplary embodiment of this specification provides an organic light emitting display comprising (n−1) th and nth pixels arranged in a row, a transistor array having a driving transistor, a sampling transistor, and a first initial transistor, and a capacitor connected between an initial voltage input terminal and the sampling transistor, wherein a gate electrode of the first initial transistor for initializing the driving transistor of the nth pixel is connected to a scan line in the (n−1)th pixel. Accordingly, a sufficient sampling period may be allowed to sample the threshold voltage of the driving transistor, thus improving the accuracy of compensation of the threshold voltage.

The capacitor is connected to receive the initial voltage, rather than a high-level driving voltage, so that the number of contact holes is minimized.

The capacitor comprises an electrode connected to the initial voltage input terminal, and a contact hole for connecting the initial voltage input terminal and the electrode. Each of the pixels further comprises a second initial transistor and an organic light emitting diode, a drain electrode or a source electrode of the second initial transistor for providing a negative voltage is connected to at least one electrode of the organic light emitting diode via the contact hole.

The capacitor comprises a first electrode that receives an initial voltage, and a second electrode connected to the driving a transistor, wherein the first electrode is larger in size than the second electrode.

The organic light emitting display further comprises a metal layer under a semiconductor layer of the driving transistor.

A first electrode of the capacitor is disposed in an area corresponding to a semiconductor layer of the sampling transistor.

The first initial transistor comprises at least two series-connected transistors, which are switched on by a same control signal.

The sampling transistor comprises at least two series-connected transistors, which are switched on by a same control signal.

The organic light emitting display further comprises an organic light emitting diode that emits light by the driving transistor; and an emission transistor that keeps the organic light emitting diode from emitting light at times other than an emission period.

The emission transistor is connected to an anode of the organic light emitting diode.

A further exemplary embodiment of this specification provides an organic light emitting display comprising (n−1) th and nth pixels arranged in a row, organic light emitting diodes arranged at each pixel, an initial transistor in the nth pixel and connected to an (n−1)th scan line of the (n−1)th pixel, a sampling transistor in the nth pixel and connected to an nth scan line, and an emission transistor in the nth pixel and connected to an nth emission line, wherein one frame for driving the organic light emitting diodes comprises an initial period, a sampling period, and an emission period, and in the initial period, an (n−1)th scan signal is applied at an ON level, and an nth scan signal and an nth emission signal are applied at an OFF level, in the sampling period, the nth scan signal is applied at the ON level, and the (n−1)th scan signal and the nth emission signal are applied at the OFF level, and in the emission period, the nth emission signal is applied at the ON level, and the (n−1)th scan signal and the nth scan signal are applied at the OFF level.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting display comprising:

a display panel having a plurality of pixels;

a gate drive circuit that drives scan lines and emission lines on the display panel, wherein a scan line is connected to each pixel in a corresponding row; and a data drive circuit that drives data lines on the display panel, wherein each of the pixels arranged in an nth row (n is a natural number) comprises:

an organic light emitting diode having an anode connected to a node C and a cathode connected to a low-level driving voltage input terminal, a driving transistor having a gate electrode connected to a node A, a source electrode connected to a high-level driving voltage input terminal, and a drain electrode connected to a node B, the driving transistor controlling a driving current applied to the organic light emitting diode, a first transistor that is connected between a data line and a node D, a second transistor that is directly connected to the node A and the node B, a third transistor that is connected between the node D and an initial voltage input terminal, a fourth transistor that is connected to the node B and the node C, a fifth transistor that is connected between the node A and the initial voltage input terminal, a sixth transistor that is connected between the initial voltage input terminal and the node C, and a capacitor that is directly connected to the node A and the node D, and wherein a gate electrode of the fifth transistor and a gate electrode of the sixth transistor are connected to an (n−1)th scan line to which an (n−1)th scan signal is applied, a gate electrode of the first transistor and a gate electrode of the second transistor are connected to an nth scan line to which an nth scan signal is applied, and a gate electrode of the third transistor and a gate electrode of the fourth transistor are connected to an nth emission line to which an nth emission signal is applied.

2. The organic light emitting display of claim 1, wherein one frame comprises an initial period in which the node A and the node C are initialized, a sampling period in which a threshold voltage of the driving transistor is sampled and stored at the node A, an emission period in which a source-gate voltage of the driving transistor is programmed to have the sampled threshold voltage, and the organic light emitting diode emits light by a driving current corresponding to the programmed source-gate voltage, wherein in the initial period, the (n−1)th scan signal is applied at an ON level, and the nth scan signal and the nth emission signal are applied at an OFF level, wherein in the sampling period, the nth scan signal is applied at the ON level, and the (n−1)th scan signal and the nth emission signal are applied at the OFF level, and wherein in the emission period, the nth emission signal is applied at the ON level, and the (n−1)th scan signal and the nth scan signal are applied at the OFF level.

3. The organic light emitting display of claim 2, wherein one frame further comprises a holding period between the initial period and the emission period, wherein in the holding period, the nth scan signal, the (n−1)th scan signal, and the nth emission signal are applied at the OFF level.

4. The organic light emitting display of claim 2, wherein the initial period is included in an (n−1)th horizontal period, and the sampling period is included in an nth horizontal period.

5. The organic light emitting display of claim 1, wherein the second transistor comprises at least two series-connected transistors, which are switched on by a same control signal.

6. The organic light emitting display of claim 1, wherein a first electrode of the capacitor that receives an initial voltage from the initial voltage input terminal overlaps the gate electrode of the driving transistor.

7. The organic light emitting display of claim 1, wherein the source electrode of the driving transistor is directly connected to the high-level driving voltage input terminal.

8. The organic light emitting display of claim 1, wherein the third transistor is directly connected between the node D and the initial voltage input terminal.

9. The organic light emitting display of claim 1, wherein the sixth transistor is directly connected between the initial voltage input terminal and the node C.

* * * * *